US007953240B2

(12) United States Patent
Matsumura et al.

(10) Patent No.: US 7,953,240 B2
(45) Date of Patent: May 31, 2011

(54) LOUDSPEAKER APPARATUS

(75) Inventors: Toshiyuki Matsumura, Osaka (JP); Shuji Saiki, Nara (JP)

(73) Assignee: Panasonic Corporation, Osaka (JP)

( * ) Notice: Subject to any disclaimer, the term of this patent is extended or adjusted under 35 U.S.C. 154(b) by 1409 days.

(21) Appl. No.: 11/437,665

(22) Filed: May 22, 2006

(65) Prior Publication Data

US 2006/0269095 A1 Nov. 30, 2006

(30) Foreign Application Priority Data

May 24, 2005 (JP) ..... 2005-150772

(51) Int. Cl.

| | |
|---|---|
| ***H04R 1/02*** | (2006.01) |
| ***H04R 1/20*** | (2006.01) |
| *H04R 25/00* | (2006.01) |
| *H04R 9/06* | (2006.01) |
| *H04R 1/00* | (2006.01) |
| *H04R 11/02* | (2006.01) |

(52) U.S. Cl. ..... 381/354; 381/150; 381/337; 381/421

(58) Field of Classification Search ..... 381/354, 381/150, 337, 421
See application file for complete search history.

(56) References Cited

U.S. PATENT DOCUMENTS 4,657,108 A * 4/1987 Ward ..... 181/151
6,574,346 B1 * 6/2003 Tanaka ..... 381/421

FOREIGN PATENT DOCUMENTS

JP 2000-308174 11/2000

* cited by examiner

*Primary Examiner* — Curtis Kuntz
*Assistant Examiner* — Matthew Eason
(74) *Attorney, Agent, or Firm* — Wenderoth, Lind & Ponack L.L.P.

(57) ABSTRACT

A loudspeaker apparatus comprises a housing, an adsorptive material provided inside the housing, for physically adsorbing gas inside the housing, a vibration section including a diaphragm and provided in an opening formed in the housing, a drive section for driving the diaphragm to generate sound from the diaphragm, and a negative stiffness generating mechanism provided inside the housing, for reducing an acoustic stiffness inside the housing, the acoustic stiffness acting on the diaphragm.

16 Claims, 19 Drawing Sheets

LOUDSPEAKER APPARATUS

BACKGROUND OF THE INVENTION

1. Field of the Invention

The present invention relates to a loudspeaker apparatus and, more particularly, to a loudspeaker apparatus which achieves low-frequency sound reproduction using a small-size cabinet.

2. Description of the Background Art

Conventionally, audio apparatuses are becoming more digitalized, and players for reproducing music sources are becoming smaller and more portable. However, loudspeaker apparatus for eventually reproducing sounds require large cabinets so as to sufficiently reproduce sounds in a low frequency region included in music sources. Therefore, loudspeaker apparatuses carried in the small-size or portable players have small-volume cabinets, so that an acoustic stiffness exhibited by the cabinet is large, and therefore, it is difficult to achieve low-frequency sound reproduction to a sufficient extent.

Therefore, a loudspeaker apparatus has been disclosed in which a limit of low-frequency sound reproduction which is determined by the volume of a cabinet is improved (see, for example, Japanese Patent Laid-Open Publication No. 2000-308174). Hereinafter, the loudspeaker apparatus will be described with reference to FIG. 16. Note that FIG. 16 is a cross-sectional view of a structure of the loudspeaker apparatus.

In FIG. 16, the conventional loudspeaker apparatus roughly comprises a cabinet 101 and a loudspeaker unit 102. The loudspeaker unit 102 has a frame 103, an edge 104, a cone-shaped diaphragm 105, a dust cap 106, a voice coil bobbin 107, a damper 108, a voice coil 109, a magnet 110, a center pole 111, a magnetic plate 112, a movable magnet 113, and a fixed magnet 114.

In FIG. 16, the loudspeaker unit 102 is attached to an opening on a front surface of the cabinet 101. The magnet 110 is in the shape of a ring. A back surface of the magnet 110 (a surface of the magnet 110 closer to a back surface of the cabinet 101) is fixed to a front surface of the center pole 111. The magnetic plate 112 is in the shape of a ring. A back surface of the magnetic plate 112 is fixed to a front surface of the magnet 110. The voice coil 109 is wound around an outer circumferential surface of an end portion closer to the back surface of the voice coil bobbin 107. The voice coil 109 is placed in a magnetic gap formed between an outer circumferential surface of a convex of the center pole 111 and an inner circumferential surface of the magnetic plate 112. The frame 103 is fixed to a front surface of the magnetic plate 112. A sound hole **103*h* is formed in the frame 103. An outer circumference of the damper 108 is fixed to the frame 103. An inner circumference of the damper 108 is fixed to the voice coil bobbin 107. An inner circumferential surface of the cone-shaped diaphragm 105 is fixed to an end portion closer to the front surface of the voice coil bobbin 107. An inner circumference of the edge 104 is fixed to an outer circumference of the cone-shaped diaphragm 105. An outer circumference of the edge 104 is fixed to the frame 103. The dust cap 106 is fixed to a center portion closer to the front surface of the cone-shaped diaphragm 105. The movable magnet 113 is in the shape of a ring. An inner circumferential surface of the movable magnet 113 is fixed to an outer circumferential surface of the voice coil bobbin 107. The movable magnet 113 is provided between the cone-shaped diaphragm 105 and the damper 108, in the voice coil bobbin 107. The fixed magnet 114 is in the shape of a ring. An inner circumferential surface of the fixed magnet 114 faces an outer circumferential surface of the movable magnet 113, forming a gap. The movable magnet 113 and the fixed magnet 114** are magnetized to the same polarity in a thickness direction (vibration direction).

Next, an operation of the conventional loudspeaker apparatus will be described. When an electrical signal is applied to the voice coil 109, driving force is generated. The cone-shaped diaphragm 105 fixed to the voice coil bobbin 107 is vibrated by the driving force. Sound is generated from the cone-shaped diaphragm 105. The above-described operation is an operation of a typical electrokinetic loudspeaker. Here, two stiffnesses act on the cone-shaped diaphragm 105. These stiffnesses act in a direction which reduces a displacement of the cone-shaped diaphragm 105. The first stiffness is restoring force caused by the edge 104 and the damper 108 which support the cone-shaped diaphragm 105 (hereinafter, the restoring force is referred to as a support system stiffness S0). The second stiffness is force caused by the air in the cabinet 101 which is expanded/compressed by a displacement of the cone-shaped diaphragm 105, returning to the original state, i.e., force which puts the displacement of the cone-shaped diaphragm 105 back to the original state (hereinafter, the force is referred to as an acoustic stiffness Sc). The acoustic stiffness Sc is represented by:

$$Sc = \frac{\rho c^2 \pi^2 a^4}{V} \tag{1}$$

where ρ represents a density of the air in the cabinet 101, c represents a sonic speed, a represents an effective radius of the cone-shaped diaphragm 105, and V represents an internal volume of the cabinet 101. The displacement of the cone-shaped diaphragm 105 is suppressed by the above-described two stiffnesses. Particularly, in the case of a loudspeaker apparatus having a small cabinet internal volume V, the acoustic stiffness due to the air in the cabinet is large. Therefore, it is difficult for the loudspeaker apparatus having a small cabinet internal volume V to reproduce a low-frequency sound region.

However, the conventional loudspeaker apparatus of FIG. 16 has a mechanism for generating force which reduces the acoustic stiffness acting on the cone-shaped diaphragm 105, i.e., a negative stiffness (hereinafter referred to as a negative stiffness generating mechanism). The negative stiffness generating mechanism is composed of the movable magnet 113 fixed to the outer circumferential surface of the voice coil bobbin 107, and the fixed magnet 114 provided facing the movable magnet 113. Hereinafter, the negative stiffness generating mechanism will be described in detail.

The movable magnet 113, when it is standing still (in the absence of a signal), is supported by a support system including the edge 104, the damper 108, and the like, and is located at a position where the movable magnet 113 and the fixed magnet 114 are magnetically balanced (hereinafter referred to as a balanced position). As described above, when an electrical signal is applied to the voice coil 109, the cone-shaped diaphragm 105 is vibrated by driving force generated in the voice coil 109. In this case, the movable magnet 113 is vibrated together with the voice coil bobbin 107 in an inner circumferential portion of the fixed magnet 114. Here, the movable magnet 113 and the fixed magnet 114 are magnetized to the same polarity in the vibration direction. Therefore, when the movable magnet 113 is displaced, a magnetic field in which the movable magnet 113 and the fixed magnet 114 repel each other is formed. Thereby, when the cone-shaped diaphragm 105 is displaced, force which allows the movable magnet 113 to escape from the balanced position, i.e., force which acts in a direction which increases the displacement, is generated in the movable magnet 113. Thus, the movable magnet 113 and the fixed magnet 114 constitute the negative stiffness generating mechanism.

As described above, the negative stiffness generating mechanism reduces the acoustic stiffness which acts on the vibration system of the loudspeaker unit 102. Thereby, the force which reduces the displacement of the cone-shaped diaphragm 105 is reduced, so that the volume V of expression (1) is equivalently increased. As a result, the loudspeaker apparatus of FIG. 16 can operate as if it carried a loudspeaker unit having a large cabinet.

Here, a specific method for expanding a reproduction band to a desired low-frequency region will be described. A low-frequency sound reproduction band of a loudspeaker apparatus is expanded by action of a negative stiffness. It is here considered that a loudspeaker apparatus with a cabinet having a volume V is used to obtain a low-frequency sound reproduction band equivalent to that of a cabinet having a volume N (N>1) times larger than V. In the case of the cabinet having the N-times volume, the acoustic stiffness value is represented by the following expression using expression (1).

$$\frac{\rho c^2 \pi^2 a^4}{NV} = \frac{1}{N} S_C \tag{2}$$

Therefore, the magnitude of a negative stiffness required in the negative stiffness generating mechanism (a reduced amount of acoustic stiffness) is represented by the following expression.

$$S_C - \frac{1}{N} S_C = \left(\frac{N-1}{N}\right) S_C \tag{3}$$

Note that the negative stiffness indicated in expression (3) indicates a value of a linear component. As indicated in expression (3), when it is tried to obtain an effect of increasing the volume V by a factor of N (hereinafter referred to as a volume expansion effect), the smaller the volume V (or the larger the value N), the larger the negative stiffness which is required in the negative stiffness generating mechanism. Note that, by the negative stiffness generating mechanism, three stiffnesses act on the cone-shaped diaphragm 105. Two of the three stiffnesses are the support system stiffness S0 and the acoustic stiffness Sc. The third stiffness is a negative stiffness which is represented by expression (3) and is generated by the negative stiffness generating mechanism. A relationship between these three stiffnesses and the displacement of the movable magnet 113 is illustrated in FIG. 17. In FIG. 17, the horizontal axis indicates the displacement of the movable magnet 113. Regarding the displacement, a front surface direction of the cone-shaped diaphragm 105 is assumed to be a positive direction. The vertical axis indicates a magnitude of stiffness acting on the cone-shaped diaphragm 105. C in FIG. 17 indicates the resultant force of the acoustic stiffness Sc and the support system stiffness S0 acting on the cone-shaped diaphragm 105. The acoustic stiffness Sc is linear with respect to the displacement. The support system stiffness S0 is nonlinear since the edge 104 and the damper 108 are tense when the displacement is large. Therefore, C of FIG. 17 is nonlinear where the displacement is large. Next, D in FIG. 17 indicates a negative stiffness generated by the negative stiffness generating mechanism. An arrow in FIG. 17 indicates a portion of D where a nonlinear change occurs. A position of the nonlinear portion indicated with the arrow is determined, depending on a thickness of the fixed magnet 114. E in FIG. 17 indicates the resultant force of C and D. Therefore, a stiffness having a magnitude indicated by E of FIG. 17 acts on the cone-shaped diaphragm 105.

Here, in the conventional loudspeaker apparatus of FIG. 16, it is necessary to generate a larger negative stiffness so as to further expand a low-frequency sound reproduction band in a small-size loudspeaker apparatus. Here, to generate a larger negative stiffness, an outer diameter of the fixed magnet 114 of the negative stiffness generating mechanism may be increased, or the thickness thereof may be reduced. When the outer diameter of the fixed magnet 114 is increased, the cost of the fixed magnet 114 increases. Also, an increase in the outer diameter of the fixed magnet 114 leads to an increase in size of the loudspeaker unit 102. It is difficult for the large-size loudspeaker unit 102 to be incorporated into a small-size loudspeaker apparatus.

When the thickness of the fixed magnet 114 is reduced to generate larger negative stiffness, the position of the nonlinear portion indicated with the arrow in FIG. 17 is shifted toward a portion having a small displacement. Therefore, in E of FIG. 17, the linear range is narrowed. Here, if the amplitude of the cone-shaped diaphragm 105 exceeds the linear range, distortion of reproduced sound is increased, resulting in a reduction in reproduced sound quality. When the low-frequency sound reproduction band is expanded, the amplitude of the cone-shaped diaphragm 105 increases. Therefore, to suppress the distortion of reproduced sound, it is necessary to limit the amplitude of the cone-shaped diaphragm 105. In other words, when the thickness of the fixed magnet 114 is reduced, it is necessary to limit the amplitude, and therefore, the maximum sound pressure of reproduced sound decreases.

Another way to generate a larger negative stiffness, an inner diameter of the fixed magnet 114 may be increased and an outer diameter of the movable magnet 113 may also be increased, thereby enhancing the magnetic forces of both the magnets. However, the volumes of the magnets increase, leading to an increase in cost and an increase in weight of the vibration system. As a result, the efficiency of the loudspeaker apparatus decreases. For the above-described reasons, in the conventional loudspeaker apparatus of FIG. 16, there is a limitation on further expansion of the low-frequency sound reproduction band in a small-size loudspeaker apparatus, and it is difficult to achieve this.

SUMMARY OF THE INVENTION

Therefore, an object of the present invention is to provide a loudspeaker apparatus capable of further expanding a low-frequency reproduction band.

A first aspect of the present invention is directed to a loudspeaker apparatus comprising a housing, an adsorptive material provided inside the housing, for physically adsorbing gas inside the housing, a vibration section including a diaphragm and provided in an opening formed in the housing, a drive section for driving the diaphragm to generate sound from the diaphragm, and a negative stiffness generating mechanism provided inside the housing, for reducing an acoustic stiffness inside the housing, the acoustic stiffness acting on the diaphragm.

In a second aspect based on the first aspect, the adsorptive material is composed of at least one of activated charcoal, zeolite, carbon nanotube, fullerene, silica gel, and porous silica.

In a third aspect based on the first aspect, the drive section is composed of a first magnetic circuit provided inside the housing and having a first magnet closer to the diaphragm, and a second magnetic circuit having a second magnet provided facing the first magnet via the diaphragm and a gap formed in a vibration direction of the diaphragm. A predetermined magnetic gap is formed in at least one of the first and second magnetic circuits. The vibration section further includes a voice coil, a voice coil bobbin fixedly provided on the diaphragm, for providing the voice coil in the magnetic gap and supporting the voice coil, and a non-magnet member which is a magnetic material which does not include a magnet, and is provided in at least a portion of the diaphragm provided in the gap. The negative stiffness generating mechanism includes the non-magnet member, the first magnetic circuit, and the second magnetic circuit. A balanced position in the gap of the non-magnet member is a reference with respect to a vibration direction of the diaphragm, and the negative stiffness generating mechanism applies repelling force in the vibration direction to the non-magnet member in a direction which allows the non-magnet member to move away from the balanced position, thereby reducing the acoustic stiffness inside the housing.

In a fourth aspect based on the third aspect, the loudspeaker apparatus further comprises a position detecting section for detecting a position in the vibration direction of any of the members of the vibration section vibrating in the vibration direction, and a control section for applying, to the voice coil, a signal obtained by adding a direct-current component based on the position of the vibration section detected by the position detecting section to a predetermined acoustic signal, to control vibration of the diaphragm so that a center of an amplitude in the vibration direction of the non-magnet member is provided at the balanced position.

In a fifth aspect based on the first aspect, the negative stiffness generating mechanism includes a partition for dividing an internal space of the housing into a first empty room and a second empty room, a drone cone provided in an opening formed in the partition, a suspension having an outer circumference fixed to the partition, for supporting the drone cone in a manner which allows the drone cone to vibrate with respect to the partition, and a repelling force generating section for, a balanced position in a vibration direction of the drone cone being as a reference, generating repelling force in the vibration direction with respect to the drone cone in a direction which allows the drone cone to move away from the balanced position.

In a sixth aspect based on the fifth aspect, the repelling force generating section includes a non-magnet member which is a magnetic material which does not include a magnet, and is provided in at least a portion of the drone cone, and a plurality of magnets forming a predetermined gap on each of a front side and a rear side in the vibration direction of the drone cone with respect to the non-magnet member, and fixedly positioned, facing the non-magnet member.

In a seventh aspect based on the fifth aspect, the repelling force generating section comprises a magnet provided in at least a portion of the drone cone, and a plurality of non-magnet members which are a magnetic material which does not include a magnet. The plurality of non-magnet members form a predetermined gap on each of a front side and a rear side in the vibration direction of the drone cone with respect to the magnet, and are each fixedly provided, facing the magnet.

In an eighth aspect based on the first aspect, the loudspeaker apparatus further comprises a fixed magnet fixedly provided to the housing at a position closer to the outside of the housing than the vibration section, and having at least a partial shape of a ring. The vibration section further includes a movable magnet having at least a partial shape of a ring having an outer circumference smaller than an inner circumference of the fixed magnet, and a support member for providing the movable magnet at a position which allows an outer circumferential surface of the movable magnet to face an inner circumferential surface of the fixed magnet via a predetermined gap, and supporting the movable magnet in a manner which allows the movable magnet to be fixedly provided to the diaphragm and vibrate together with the diaphragm. The negative stiffness generating mechanism is composed of the fixed magnet and the movable magnet, a balanced position in the gap of the movable magnet is a reference with respect to a vibration direction of the diaphragm, and the negative stiffness generating mechanism applies repelling force in the vibration direction to the movable magnet in a direction which allows the movable magnet to move away from the balanced position, thereby reducing the acoustic stiffness inside the housing.

In a ninth aspect based on the eighth aspect, a magnetic gap is formed in the drive section. The vibration section further includes a voice coil which is provided in the magnetic gap and vibrates together with the diaphragm. The loudspeaker apparatus further comprises a position detecting section for detecting a position in the vibration direction of any of the members of the vibration section vibrating in the vibration direction, and a control section for applying, to the voice coil, a signal obtained by adding a direct-current component based on the position of the vibration section detected by the position detecting section to a predetermined acoustic signal, to control vibration of the diaphragm so that a center of an amplitude in the vibration direction of the movable magnet is provided at the balanced position.

In a tenth aspect based on the first aspect, the drive section is a piezoelectric converter.

In an eleventh aspect based on the tenth aspect, the diaphragm is composed of any of a member including a non-magnet member which is a magnetic material which does not include a magnet, and a member provided with the non-magnet member there outside. The drive section is a piezoelectric element provided in the diaphragm. The loudspeaker apparatus further comprises a position detecting section for detecting a position in the vibration direction of any of the members of the vibration section vibrating in the vibration direction, and a control section for applying, to the piezoelectric element, a signal obtained by adding a direct-current component based on the position of the vibration section detected by the position detecting section to a predetermined acoustic signal, to control vibration of the diaphragm so that a center of an amplitude in the vibration direction of the non-magnet member is provided at the balanced position of the non-magnet member.

In a twelfth aspect based on the first aspect, the drive section is an electrostatic converter.

In a thirteenth aspect based on the twelfth aspect, the diaphragm is composed of any of a member including a non-magnet member which is a magnetic material which does not include a magnet, and a member provided with the non-magnet member there outside. The drive section includes an electrode provided via a gap with respect to each of both surfaces of the diaphragm. The loudspeaker apparatus further comprises a position detecting section for detecting a position in the vibration direction of any of the members of the vibration section vibrating in the vibration direction, and a control section for applying, to the electrode, a signal obtained by adding a direct-current component based on the position of the vibration section detected by the position detecting section to a predetermined acoustic signal, to control vibration of the diaphragm so that a center of an amplitude in the vibration direction of the non-magnet member is provided at the balanced position of the non-magnet member.

In a fourteenth aspect based on the first aspect, the loudspeaker apparatus further comprises a support member provided to partition between the adsorptive material, and the vibration section, the drive section and the negative stiffness generating mechanism, for supporting the adsorptive material.

A fifteenth aspect of the present invention is directed to a low-frequency sound enforcing apparatus provided inside a loudspeaker apparatus, comprising a housing, an adsorptive material provided inside the housing, for physically adsorbing gas inside the housing, and a negative stiffness generating mechanism provided in an opening provided in the housing, for reducing an acoustic stiffness inside the housing.

In a sixteenth aspect based on the fifteenth aspect, the negative stiffness generating mechanism includes a drone cone provided in the opening, a suspension having an outer circumference fixedly provided to the opening, for supporting the drone cone in a manner which allows the drone cone to vibrate with respect to the housing, and a repelling force generating section for, a balanced position in a vibration direction of the drone cone being as a reference, generating repelling force in a direction which allows the drone cone to move away from the balanced position.

A seventeenth aspect of the present invention is directed to a car comprising the loudspeaker apparatus according to the first aspect, and a car body inside which the loudspeaker apparatus is provided.

An eighteenth aspect of the present invention is directed to a video apparatus comprising the loudspeaker apparatus according to the first aspect, and an apparatus housing inside which the loudspeaker apparatus is provided.

A nineteenth aspect of the present invention is directed to a mobile information processing apparatus comprising the loudspeaker apparatus according to the first aspect, and an apparatus housing inside which the loudspeaker apparatus is provided.

According to the first aspect, due to the physical adsorption effect of the adsorptive material and the negative stiffness generating mechanism, the acoustic stiffness inside the housing is reduced, so that a low-frequency sound reproduction band is expanded. In other words, the expansion of the low-frequency sound reproduction band is achieved by the adsorptive material and the negative stiffness generating mechanism. Thereby, the magnitude of a negative stiffness to be generated by the negative stiffness generating mechanism can be small as compared to the conventional loudspeaker apparatus composed only of the negative stiffness generating mechanism. In other words, the load on the negative stiffness generating mechanism is reduced as compared to the conventional art, it is possible to suppress the increase of the size of a magnet used in the negative stiffness generating mechanism, the increase of cost of the magnet, the reduction of maximum sound pressure of reproduced sound, the occurrence of distortion of reproduced sound, and the like, thereby making it possible to further expand the low-frequency sound reproduction band.

According to the second aspect, it is possible to equivalently increase the volume of the housing to expand a low-frequency sound reproduction band.

According to the third aspect, repelling force is applied to the non-magnet member in a direction which allows the non-magnet member to move away from the balanced position in the gap, due to magnetic fields formed by the first and second magnetic circuits in the gap. In other words, the diaphragm in at least a portion of which the non-magnet member is provided, vibrates by receiving force in a direction which increases the amplitude. Thereby, the acoustic stiffness inside the housing is reduced, thereby making it possible to expand a low-frequency sound reproduction band. The repelling force applied to the non-magnet member is generated by the magnetic field formed in the gap by the first and second magnetic circuits. In other words, even when the thickness of the non-magnet member is reduced to some extent, a sufficient level of repelling force is generated by the first and second magnetic circuits. Therefore, the non-magnet member can be made thinner while maintaining the repelling force, thereby making it possible to reduce the weight of the vibration section. As a result, it is possible to reduce a reduction in an output sound pressure level of the loudspeaker apparatus. Also, the first and second magnetic circuits play a role in applying repelling force to the non-magnet member, and forming the magnetic gap and applying driving force to the voice coil, due to the magnetic field generated by themselves. In other words, according to the third aspect, a magnet for applying repelling force to the non-magnet member and a magnet for applying driving force to the voice coil can be obtained with a single magnet, thereby reducing the number of parts of the loudspeaker apparatus.

According to the fourth aspect, by correcting an unbalanced displacement of the vibrating portion, it is possible to achieve a stable operation in which the center of the amplitude of the non-magnet member is the balanced position, irrespective a change in ambient environments of the loudspeaker apparatus (e.g., a change in temperature, etc.), thereby making it possible to provide a high sound quality loudspeaker apparatus in which a reduction in efficiency and a distortion are small. Also, according to an effect of the adsorptive material, the negative stiffness generated by the negative stiffness generating mechanism may be small as compared to the conventional art. Thereby, it is possible to reduce a force for correcting the unbalanced displacement of the vibrating portion, so that the control signal supplied to the voice coil can be reduced, resulting in an easy control. Also, it is advantageous in terms of the cost of a control circuit element including an amplifier circuit. In addition, the heat generation of the voice coil due to the control signal is suppressed, thereby reducing the risk of cut of the voice coil due to heat. Thereby, as compared to the conventional art, it is possible to reduce the weight of the vibration system by using a voice coil having a thin line diameter, and improve the efficiency of the loudspeaker apparatus.

According to the fifth aspect, in the negative stiffness generating mechanism provided inside the housing, the repelling force generating section applies repelling force to the drone cone in a direction which allows the drone cone to move away from the balanced position, thereby making it possible to reduce the acoustic stiffness of the whole inside of the housing which acts on the diaphragm. As a result, it is possible to expand a low-frequency sound reproduction band.

According to the sixth aspect, pulling force is alternately applied form the magnet fixedly provided to the non-magnet member of the drone cone, thereby making it possible to apply the repelling force to the drone cone to generate a negative stiffness.

According to the seventh aspect, pulling force is alternately applied from the non-magnet member fixedly provided to the magnet of the drone cone, thereby making it possible to apply the repelling force to the drone cone to generate a negative stiffness.

According to the eighth aspect, repelling force in the vibration direction is applied to the movable magnet in a direction which allows the movable magnet to move away from the balanced position, thereby making it possible to reduce an acoustic stiffness inside the housing, so that a low-frequency sound reproduction band can be expanded. Also, in this aspect, the movable magnet and the fixed magnet do not strike each other in the vibration direction. Therefore, the present invention can be useful as a large-input loudspeaker apparatus having a large amplitude.

According to the ninth aspect, by correcting an unbalanced displacement of the vibrating portion, it is possible to achieve a stable operation in which the center of the amplitude of the movable magnet is the balanced position, irrespective a change in ambient environments of the loudspeaker apparatus (e.g., a change in temperature, etc.), thereby making it possible to provide a high sound quality loudspeaker apparatus in which a distortion is small. Also, according to the effect of the adsorptive material, the negative stiffness generated by the negative stiffness generating mechanism may be small as compared to the conventional art. Thereby, it is possible to reduce a force for correcting the unbalanced displacement of the vibrating portion, so that the control signal supplied to the voice coil can be reduced, resulting in an easy control. Also, it is advantageous in terms of the cost of a control circuit element including an amplifier circuit. In addition, the heat generation of the voice coil due to the control signal is suppressed, thereby reducing the risk of cut of the voice coil due to heat. Thereby, as compared to the conventional art, it is possible to reduce the weight of the vibration system by using a voice coil having a thin line diameter, and improve the efficiency of the loudspeaker apparatus.

According to the tenth aspect, in the loudspeaker apparatus employing a piezoelectric converter, it is possible to expand a low-frequency sound reproduction band.

According to the eleventh aspect, it is possible to achieve a stable operation in which the center of the amplitude of the non-magnet member is the balanced position, irrespective a change in ambient environments of the loudspeaker apparatus (e.g., a change in temperature, etc.), thereby making it possible to provide a high sound quality loudspeaker apparatus in which a distortion is small.

According to the twelfth aspect, in the loudspeaker apparatus employing an electrostatic converter, it is possible to expand a low-frequency sound reproduction band.

According to the thirteenth aspect, by correcting an unbalanced displacement of the vibrating portion, it is possible to achieve a stable operation in which the center of the amplitude of the non-magnet member is the balanced position, irrespective a change in ambient environments of the loudspeaker apparatus (e.g., a change in temperature, etc.), thereby making it possible to provide a high sound quality loudspeaker apparatus in which a distortion is small. Also, according to an effect of the adsorptive material, the negative stiffness generated by the negative stiffness generating mechanism may be small as compared to the conventional art. Thereby, it is possible to reduce a force for correcting the unbalanced displacement of the vibrating portion, resulting in an easy control. As a result, the stability of the operation of the loudspeaker apparatus is improved.

According to the fourteenth aspect, it is possible to prevent a grain or a fiber of the adsorptive material from contacting the vibration section, the drive section, and the negative stiffness generating mechanism member. Thereby, malfunctions, such as noise and the like, can be prevented.

According to the fifteenth aspect, the low-frequency sound enforcing apparatus is provided inside conventional loudspeaker apparatuses, thereby making it possible to easily extend the reproduction limit of a low-frequency sound region of the loudspeaker apparatus. In other words, only by providing the low-frequency sound enforcing apparatus of this aspect inside a loudspeaker apparatus possessed by a user, the low-frequency sound of the current loudspeaker system can be enhanced.

According to the sixteenth aspect, the repelling force generating section applies repelling force to the drone cone in a direction which allows the drone cone to move away from the balanced position, so that the amplitude of the drone cone is increased by the repelling force, thereby making it possible to reduce an acoustic stiffness inside the housing.

These and other objects, features, aspects and advantages of the present invention will become more apparent from the following detailed description of the present invention when taken in conjunction with the accompanying drawings.

DETAILED DESCRIPTION OF THE PREFERRED EMBODIMENTS INVENTION

First Embodiment

Figure 1:
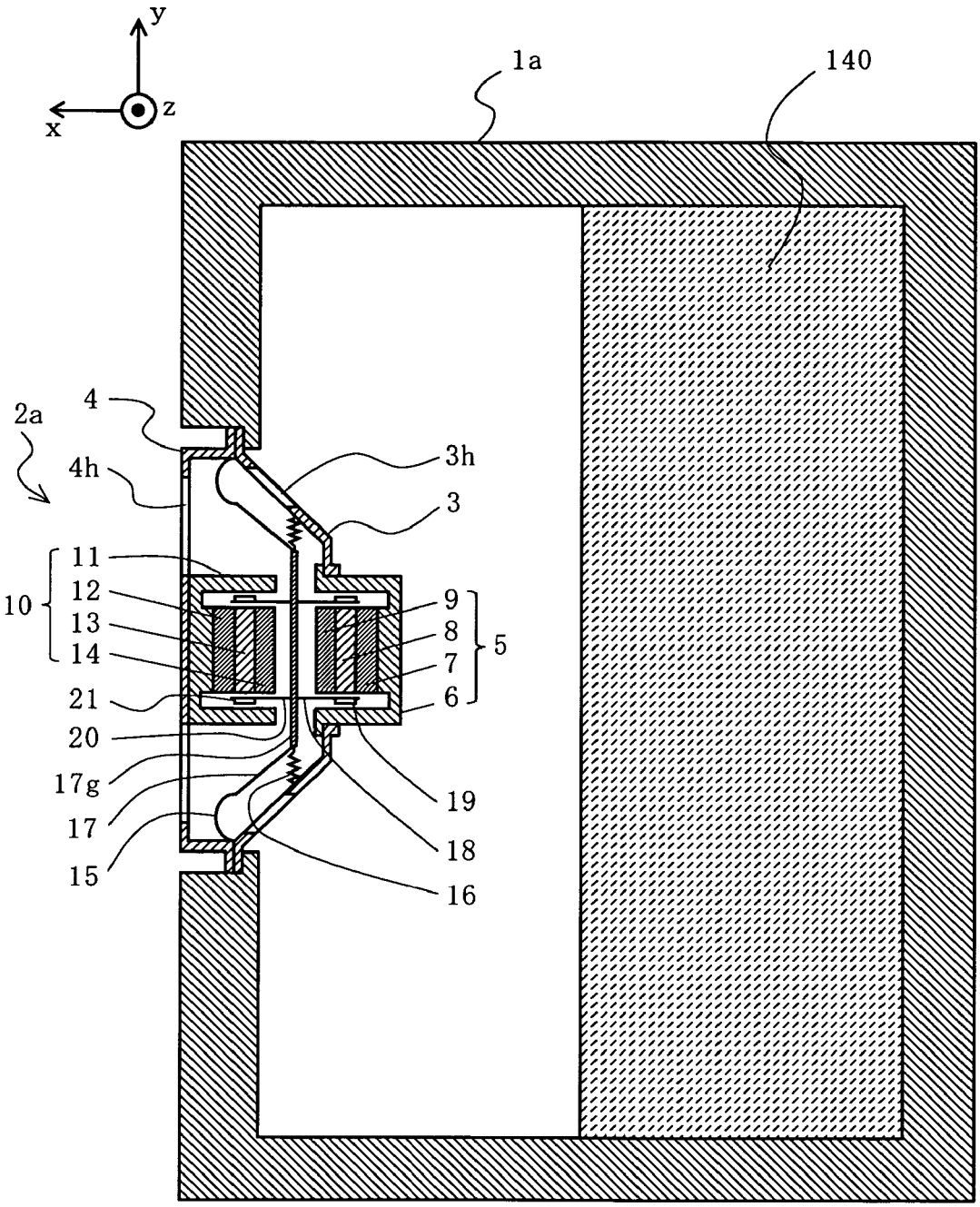
FIG. 1 is a cross-sectional view of a structure of a loudspeaker apparatus of a first embodiment of the present invention.

A loudspeaker apparatus according to a first embodiment of the present invention will be described with reference to FIG. 1. FIG. 1 is a cross-sectional view of a structure of the loudspeaker apparatus of the first embodiment. In FIG. 1, the loudspeaker apparatus roughly comprises a cabinet 1*a*, a loudspeaker unit 2*a*, and an adsorptive material 140. Note that the loudspeaker apparatus of this embodiment is, for example, of the closed-box type.

In FIG. 1, the adsorptive material 140 is provided inside the cabinet 1*a*. The adsorptive material 140 is a porous material which physically adsorbs gas (e.g., activated charcoal). Examples of activated charcoal include granular activated charcoal, fibrous activated charcoal, and the like. The porous material can adsorb gas with pores having a size of the order of micrometers. Other examples of the porous material include zeolite, silica ($SiO_2$), alumina ($Al_2O_3$), zirconia ($ZrO_3$), magnesia (MgO), triion tetroxide ($Fe_3O_4$), molecular sieve, fullerene, carbon nanotube, and the like. Note that examples of silica ($SiO_2$) include silica gel, porous silica, and the like. Alumina, zirconia, magnesia, and triion tetroxide are used in the form of powder, for example.

The loudspeaker unit 2*a*, which is in the shape of, for example, a circle, is attached to an opening formed in a front surface (the positive direction of an x axis of FIG. 1) of the cabinet 1*a*. The cabinet 1*a* is a housing which gives an acoustic stiffness to a diaphragm of the loudspeaker unit 2*a*. The loudspeaker unit 2*a* has a back surface frame 3, a front surface frame 4, a first magnetic circuit 5, a second magnetic circuit 10, an edge 15, a damper 16, a diaphragm 17, a first voice coil bobbin 18, a first voice coil 19, a second voice coil bobbin 20, and a second voice coil 21.

The back surface frame 3 has a shape in which an inner portion thereof is projected in the shape of a convex with respect to an outer circumferential portion thereof. The outer circumference of the back surface frame 3 is attached to the opening of the cabinet 1*a*, and the back surface frame 3 is convex toward the inside of the cabinet 1*a*. A sound hole 3*h* which is in air communication with the inside of the cabinet 1*a*, is formed in the back surface frame 3. An opening for attaching the first magnetic circuit 5 is formed at a center of the inner portion of the back surface frame 3. The front surface frame 4 is fixed to the outer circumferential portion of the back surface frame 3. A sound hole 4*h* for emitting sound forward is formed in the front surface frame 4. The first magnetic circuit 5 is fixed to the opening formed at the center of the inner portion of the back surface frame 3. The second magnetic circuit 10 is fixed to a center portion of a back surface (the negative direction of the x axis) of the front surface frame 4, and is positioned, facing the first magnetic circuit 5. The first and second magnetic circuits 5 and 10 have an outer shape, such as a cylindrical shape or the like. The second magnetic circuit 10 is placed at a position which allows a center axis thereof coincides with a center axis of the first magnetic circuit 5. The diaphragm 17 is placed in a gap between the first magnetic circuit 5 and the second magnetic circuit 10. At least a portion of the diaphragm 17 is composed of a non-magnet member 17*g*. The first voice coil bobbin 18 is a cylindrical member which is fixed to a surface facing the first magnetic circuit 5 of the non-magnet member 17*g*. The first voice coil 19 is wound around an outer circumferential surface of the first voice coil bobbin 18. The second voice coil bobbin 20 is a cylindrical member which is fixed to a surface facing the second magnetic circuit 10 of the non-magnet member 17*g*. The second voice coil 21 is wound around an outer circumferential surface of the second voice coil bobbin 20. An outer circumference of the edge 15 is fixed to an outer circumference of the back surface frame 3. An inner circumference of the edge 15 is fixed to an outer circumference of the diaphragm 17. Note that the diaphragm 17 and the edge 15 may be integrated together. An outer circumference of the damper 16 is fixed to the back surface frame 3. An inner circumference of the damper 16 is fixed to the diaphragm 17. Note that, as used herein, in the loudspeaker unit 2*a*, the diaphragm 17 (including the non-magnet member 17*g*), the first and second voice coil bobbins 18 and 20, and the first and second voice coils 19 and 21, are vibration elements which are vibrated by an input electrical signal. The edge 15 and the damper 16 are support elements which support the vibration elements in a manner which allows the non-magnet member 17*g* to vibrate in the gap between the first magnetic circuit 5 and the second magnetic circuit 10. As used herein, the vibration elements and the support elements constitute a vibration section.

The first magnetic circuit 5*h* as a yoke 6, a first magnet 7, a magnetic plate 8, and a second magnet 9. For example, the yoke 6 has a cylindrical side surface, a bottom surface which is formed at one end of the side surface, and an opening which is formed on the other end. Also, a collar portion is provided on an outer circumference at the other end (opening), extending in the outer circumference direction. The yoke 6 is fixed to the opening formed at the center of the inner portion of the back surface frame 3, using the collar portion. The first magnet 7 is in the shape of a cylinder and is fixed to a center portion of an inner bottom surface of the yoke 6. The magnetic plate 8 is in the shape of a cylinder and is fixed to a front surface of the first magnet 7. The second magnet 9 is in the shape of a cylinder and is fixed to a front surface of the magnetic plate 8. A gap is formed between an outer circumferential surface of each of the first magnet 7, the magnetic plate 8, and the second magnet 9, and an inner cylindrical surface of the yoke 6. In the gap, a magnetic gap is formed between the outer circumferential surface of the magnetic plate 8 and the inner circumferential surface of the yoke 6. Note that the first voice coil 19 is placed in the magnetic gap formed in the first magnetic circuit 5, using the first voice coil bobbin 18. The first magnet 7 and the second magnet 9 are each magnetized in a vibration direction (an x-axis direction) of the diaphragm 17. The magnetization directions of the first magnet 7 and the second magnet 9 are opposite to each other.

Here, a magnetic flux of the second magnet 9 passes via the magnetic plate 8 through the magnetic gap. Also, since the second magnet 9 is magnetized in a direction which causes the second magnet 9 to repel the first magnet 7, the magnetic flux of the first magnet 7 passes through the magnetic gap in a further concentrated manner. In other words, the second magnet 9 plays a role in increasing the magnetic flux density in the magnetic gap to increase the driving force of the first voice coil 19.

The second magnetic circuit 10 has a yoke 11, a first magnet 12, a magnetic plate 13, and a second magnet 14. The yoke 11 has a cylindrical side surface, a bottom surface which is formed at one end of the side surface, and an opening which is formed on the other end. The bottom surface of the yoke 11 is fixed to a center portion of a back surface of the front surface frame 4. The first magnet 12 is in the shape of a cylinder and is fixed to a center portion of a back surface of the yoke 11. The magnetic plate 13 is in the shape of a cylinder and is fixed to a back surface of the first magnet 12. The second magnet 14 is in the shape of a cylinder and is fixed to a back surface of the magnetic plate 13. Here, a magnetic gap is formed between an outer circumferential surface of the magnetic plate 13 and an inner circumferential surface of the yoke 11. The second voice coil 21 is placed in the magnetic gap in the second magnetic circuit 10, using the second voice coil bobbin 20. The first magnet 12 and the second magnet 14 are each magnetized in the vibration direction (the x-axis direction) of the diaphragm 17. The magnetization directions of the first magnet 12 and the second magnet 14 are opposite to each other. Note that the second magnet 14 enhances the driving force of the second voice coil 21 as with the above-described second magnet 9.

Here, the magnetization directions of the second magnet 9 and the second magnet 14, and the winding directions of the first and second voice coils 19 and 21, will be described. When the magnetization direction of the second magnet 9 is caused to be the same as that of the second magnet 14, the winding directions of the first and second voice coils 19 and 21 are set to be opposite to each other. When the magnetization direction of the second magnet 9 is caused to be opposite to that of the second magnet 14, the winding directions of the first and second voice coils 19 and 21 are set to be the same. Thereby, when a current is applied to the first and second voice coils 19 and 21, driving force is obtained in the same direction.

The diaphragm 17 is in the shape of a cone. At least a portion of the diaphragm 17 is composed of the non-magnet member 17*g*. Here, the non-magnet member 17*g* is a magnetic material other than magnets. Examples of the non-magnet member 17*g* includes magnetic materials, such as iron, permalloy, and the like, which do not as strong a coercive force as that of magnets. The non-magnet member 17*g* needs to be placed in at least a gap between the first and second magnetic circuits 5 and 6. Therefore, for example, the entire surface of the diaphragm 17 may be composed of the non-magnet member 17*g*. Alternatively, for example, in the diaphragm 17, only a portion corresponding to an inner portion of the outer circumferential shape of the yoke 6 or the yoke 11 may be composed of the non-magnet member 17*g*. An area obtained by projecting the gap formed in each of the first and second magnetic circuits 5 and 6 perpendicularly onto the diaphragm 17 is in the shape of a ring. A magnetic field in the vicinity of the ring-shaped area can generate repelling force (described below) most strongly with respect to the non-magnet member 17*g*. Therefore, at least the ring-shaped area of the diaphragm 17 is preferably composed of the non-magnet member 17*g*. Note that, as a specific exemplary structure of the diaphragm 17 and the non-magnet member 17*g*, a plate-shaped non-magnet member 17*g* may be joined onto both or either of the surfaces of a non-magnetic material diaphragm 17.

Next, an operation of the loudspeaker apparatus of this embodiment will be described. When an electrical signal is applied to the first voice coil 19 and the second voice coil 21, a current flows through each voice coil and a magnetic field is formed in each magnetic gap, so that driving force is generated in each voice coil in the same direction. Each driving force vibrates the diaphragm 17 in the front-to-back surface direction (the x-axis direction), thereby generating sound pressure. The sound pressure generated by the diaphragm 17 changes the internal pressure of the cabinet 1*a*. However, the adsorptive material 140 is provided in the cabinet 1*a*. Therefore, a change in pressure in the cabinet 1*a* is suppressed by physical adsorption action of the adsorptive material 140. Thereby, the acoustic stiffness of the cabinet 1*a* is reduced. In other words, the adsorptive material 140 plays a role in suppressing the pressure change in the cabinet 1*a*, thereby reducing the acoustic stiffness of the cabinet 1*a*.

On the other hand, the diaphragm 17 at least a portion of which is composed of the non-magnet member 17*g*, vibrates in the gap between the first magnetic circuit 5 and the second magnetic circuit 10. The vibration direction of the diaphragm 17 is the front-to-back surface direction (the x-axis direction). In this case, pulling force in the vibration direction is alternately applied to the non-magnet member 17*g* by the magnetic fields formed by the first and second magnetic circuits 5 and 6, depending on the vibration of the diaphragm 17. For example, when the diaphragm 17 is displaced closer to the first magnetic circuit 5, force is applied to the non-magnet member 17*g* by the magnetic fields formed by the first and second magnetic circuits 5 and 6 in a direction which increases the displacement. In other words, the non-magnet member 17*g* vibrates while receiving force in a direction which causes the non-magnet member 17*g* to go away from a balanced position present in the gap between the first magnetic circuit 5 and the second magnetic circuit 10 (hereinafter referred to as repelling force). Note that the balanced position indicates a position where the repelling force acting on the non-magnet member 17*g* is balanced in the vibration direction, in the gap between the first magnetic circuit 5 and the second magnetic circuit 10.

Here, the acoustic stiffness of an internal empty room of the cabinet 1*a* enclosed by the cabinet 1*a*, the diaphragm 17, and the edge 15 suppresses the vibration of the diaphragm 17 using the spring force. The spring force increases with a decrease in volume of the internal empty room. Also, the larger the spring force, the more significantly the vibration of the diaphragm 17 is suppressed. In contrast to this, the repelling force applied to the non-magnet member 17*g* acts in a direction which cancels the spring force of the acoustic stiffness. In other words, the repelling force acts as a negative stiffness which reduces the acoustic stiffness. The non-magnet member 17*g*, the first magnetic circuit 5, and the second magnetic circuit 10 play a role as a mechanism for generating a negative stiffness (negative stiffness generating mechanism).

Thus, the acoustic stiffness of the cabinet 1*a* is reduced by both actions of the acoustic stiffness reducing effect of the adsorptive material 140 and the negative stiffness generated by the negative stiffness generating mechanism. Due to the reduction of the acoustic stiffness, the internal volume of the cabinet 1*a* is equivalently increased, so that the diaphragm 17 becomes easy to vibrate, and therefore, a minimum resonant frequency of the loudspeaker unit 2*a* is reduced. As a result, the low-frequency sound reproduction limit of the loudspeaker apparatus is expanded.

Here, a specific setting method for extending the reproduction band to a desired low-frequency sound region, will be described. As described above, the volume increasing effect of each of the adsorptive material 140 and the negative stiffness generating mechanism expands the low-frequency sound reproduction band. Therefore, when the desired low-frequency sound region is set, the volume increasing effect of each of the adsorptive material 140 and the negative stiffness generating mechanism may be taken into consideration. Hereinafter, the case where a volume increasing effect when the desired low-frequency sound region is obtained provides a volume N (N>1) times larger than an actual volume, will be described.

An acoustic stiffness S1 of the cabinet 1*a* with respect to the diaphragm 17 is represented by:

$$S1 = \frac{\rho c^2 \pi^2 a^4}{V} \tag{4}$$

where V represents an actual volume of the cabinet 1*a*, a represents an effective radius of the diaphragm 17, ρ represents an air density, and c represents a sonic speed.

Here, an acoustic stiffness S2 when the volume of the cabinet 1*a* is increased by a factor of N (the volume becomes NV) is represented by the following expression, based on expression (4).

$$S2 = \frac{\rho c^2 \pi^2 a^4}{NV} \tag{5}$$

Therefore, according to the expressions (4) and (5), a reduced amount of acoustic stiffness required to equivalently increase the volume of the cabinet 1*a* by a factor of N, is represented by the following expression.

$$S1 - S2 = \left(\frac{N-1}{N}\right)S1 \tag{6}$$

Here, when the adsorptive material 140 whose volume increasing effect has a factor of M (M>1) is provided in the cabinet 1*a* having the acoustic stiffness S1, a reduced amount of the acoustic stiffness S1 is represented by the following expression.

$$\left(\frac{M-1}{M}\right)S1 \tag{7}$$

Also, in the cabinet 1*a* having the acoustic stiffness S1, a reduced amount of the acoustic stiffness S1 by the negative stiffness generating mechanism whose volume increasing effect has a factor of L (L>1) is represented by the following expression.

$$\left(\frac{L-1}{L}\right)S1 \tag{8}$$

Note that expression (8) indicates a linear component of the negative stiffness generated by the negative stiffness generating mechanism.

Therefore, when the volume of the cabinet 1*a* is increased by a factor of N by the adsorptive material 140 and the negative stiffness generating mechanism, the following relational expression is satisfied in accordance with the expressions (6) to (8).

$$\left(\frac{N-1}{N}\right)S1 = \left(\frac{L-1}{L}\right)S1 + \left(\frac{M-1}{M}\right)S1 \tag{9}$$

Thus, the volume increasing effects of the adsorptive material 140 and the negative stiffness generating mechanism may be set so as to satisfy expression (9). Thereby, a desired low-frequency sound reproduction band can be obtained.

Hereinafter, the above description will be described using a specific example of numerical values. For example, when a design is provided so as to obtain a volume increasing effect having a factor of 6, a required reduced amount of acoustic stiffness is calculated to be ⅚*S1 by substituting N=6 into expression (6). Here, assuming that a volume increasing effect having a factor of 3 is obtained by the adsorptive material 140, a reduced amount of acoustic stiffness due to the adsorptive material 140 is calculated to be ⅔*S1 by substituting M=3 into expression (7). Therefore, according to expression (9), a reduced amount of acoustic stiffness by the negative stiffness generating mechanism is ⅙*S1. In other words, a negative stiffness required in the negative stiffness generating mechanism is ⅙*S1. Thus, when the volume increasing effect having a factor of 6 is obtained only by the negative stiffness generating mechanism, a negative stiffness corresponding to ⅚*S1 needs to be generated. However, the adsorptive material 140 reduces the acoustic stiffness of the cabinet 1*a* by ⅔*S1. Therefore, the magnitude of the negative stiffness required for the negative stiffness generating mechanism is decreased by a factor of (⅚*S1)/(⅔*S1)=⅙, as compared to when the volume increasing effect is achieved only by the negative stiffness generating mechanism.

As described above, in this embodiment, the volume of the cabinet 1*a* is equivalently increased by the actions of both the adsorptive material 140 and the negative stiffness generating mechanism, thereby making it possible to extend the reproduction limit of a low-frequency sound region. In other words, the expansion of the low-frequency sound reproduction band is achieved by the stiffness reduction of both the adsorptive material 140 and the negative stiffness generating mechanism. Thereby, the magnitude of the negative stiffness required by the negative stiffness generating mechanism is small as compared to the conventional loudspeaker apparatus composed only of the negative stiffness generating mechanism. Thus, the load on the negative stiffness generating mechanism is reduced as compared to the conventional art, so that it is possible to suppress the increase of the size of a magnet used in the negative stiffness generating mechanism, the increase of cost of the magnet, the reduction of maximum sound pressure of reproduced sound, the occurrence of distortion of reproduced sound, and the like, thereby making it possible to further expand the low-frequency sound reproduction band in a small-size loudspeaker apparatus. Thus, according to this embodiment, it is possible to achieve further expansion of a low-frequency sound reproduction band, which cannot be achieved in the conventional art. Specifically, when a low-frequency sound reproduction band is expanded by a desired amount, the magnitude of the negative stiffness required by the negative stiffness generating mechanism can be reduced by an amount corresponding to the action of the absorptive material 140 as compared to the conventional art. Thereby, the increase of the size of a magnet used in the negative stiffness generating mechanism, the increase of cost of the magnet, the reduction of maximum sound pressure of reproduced sound, the occurrence of distortion of reproduced sound, and the like, are suppressed, thereby making it possible to expand the low-frequency sound reproduction band by an amount corresponding to the suppression as compared to the conventional art. Note that, when a low-frequency sound reproduction band is expanded by the same amount as in the conventional art, it is possible to suppress the reduction of the maximum sound pressure of reproduced sound, the occurrence of distortion of reproduced sound, and the like, as compared to the conventional art. Also, it is possible to further reduce the size of the loudspeaker apparatus as compared to the conventional art.

Figure 2A:
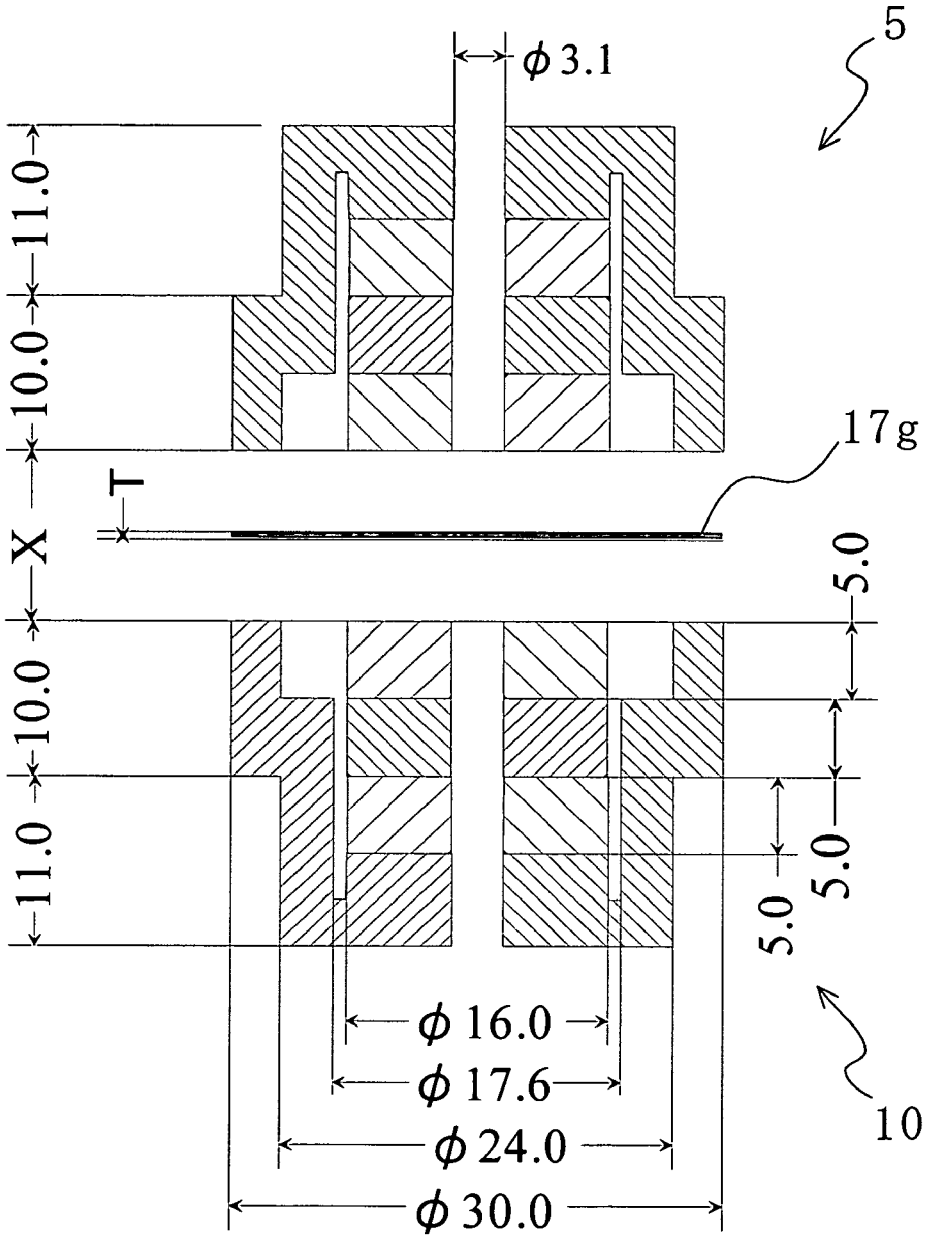
FIG. 2A is a cross-sectional view of a structure of a magnetic circuit where a magnetic field was analyzed.

The above description will be described using a specific example. FIG. 2A illustrates a first magnetic circuit 5, a second magnetic circuit 10, and a non-magnet member 17*g* for which magnetic field analysis was performed. Note that the first magnetic circuit 5 and the second magnetic circuit 10 of FIG. 2A have a shape different from that of FIG. 1, but have the same function. The diaphragm 17 and the like do not have an influence on a magnetic field and are not illustrated. The first magnetic circuit 5 and the second magnetic circuit 10 have a symmetrical structure with respect to the non-magnetic member 17*g* provided therebetween. Here, a gap between the first magnetic circuit 5 and the second magnetic circuit 10 is represented by X, and a thickness of the non-magnetic member 17*g* is represented by T. Note that numerical values (11.0, 10.0, etc.) in FIG. 2A indicate dimensions of the first magnetic circuit 5 and the second magnetic circuit 10, which are expressed in millimeters. Note that values indicated by ϕ (ϕ3.1, etc.) indicate diameters.

Figure 2B:
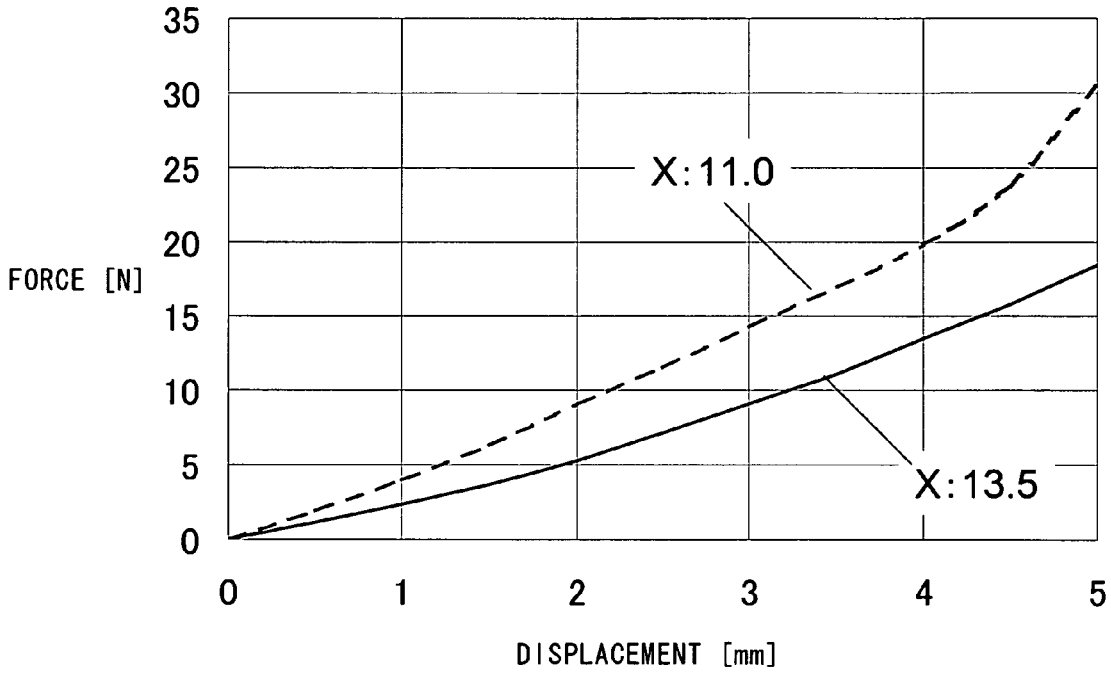
FIG. 2B is a diagram illustrating a result of magnetic field analysis of a relationship between a displacement of a non-magnet member 17*g* and a force acting on the non-magnet member 17*g* when X of FIG. 2A is changed.

FIG. 2B is a diagram illustrating a result of magnetic field analysis of a relationship between a displacement of the non-magnetic member 17*g* and a force acting on the non-magnetic member 17*g*. In FIG. 2B, the horizontal axis indicates the displacement of the non-magnetic member 17*g*, and the vertical axis indicates a magnitude of the force acting on the non-magnetic member 17*g*. In FIG. 2B, a result which provides X=11.0 mm and 13.5 mm under a condition that T=0.5 mm, is illustrated. Note that, in FIG. 2B, a displacement in a negative direction (a direction from the non-magnetic member 17*g* to the second magnetic circuit 10 in FIG. 2A) of the non-magnetic member 17*g* is symmetrical to a positive direction (a direction from the non-magnetic member 17*g* to the first magnetic circuit 5 in FIG. 2A), and therefore, is not illustrated. According to the result of the magnetic field analysis, when the gap X between the first magnetic circuit 5 and the second magnetic circuit 10 is increased, the linearity is improved, though a generated negative stiffness decreases. Thereby, it is found that, when the negative stiffness generated by the negative stiffness generating mechanism is reduced by using both the adsorptive material 140 and the negative stiffness generating mechanism, the linearity with respect to the amplitude of the non-magnet member 17*g* can be improved. As a result, the occurrence of distortion of reproduced sound can be suppressed.

Figure 2C:
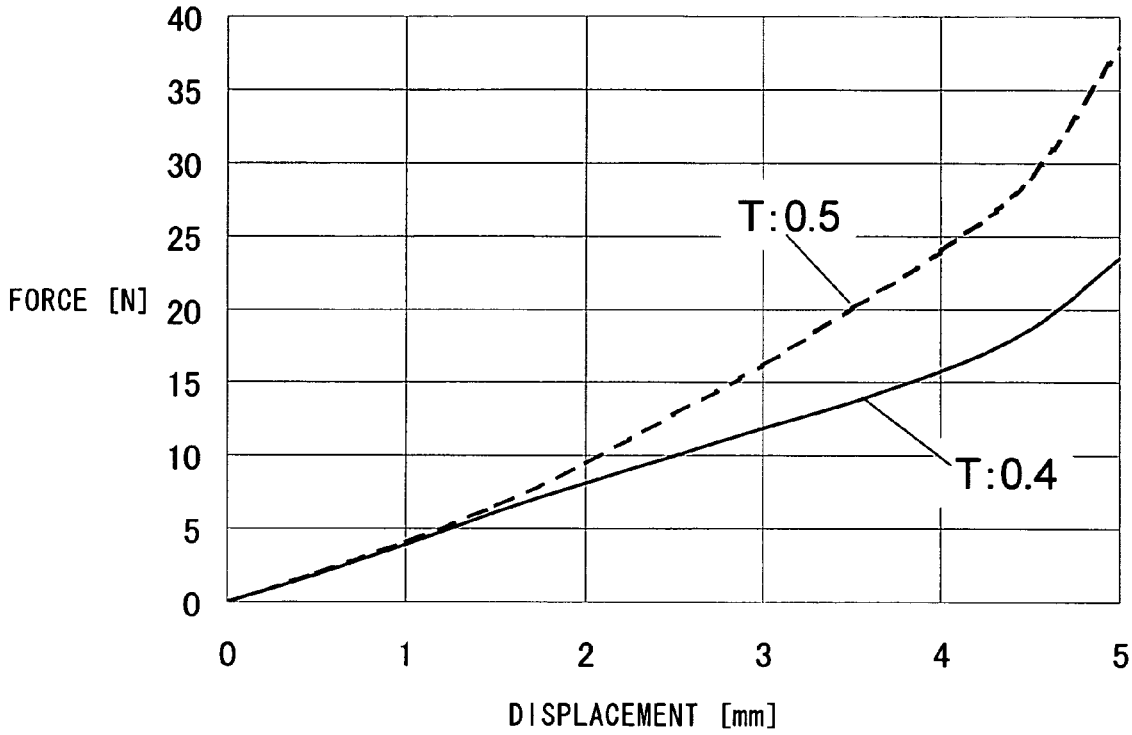
FIG. 2C is a diagram illustrating a result of magnetic field analysis of a relationship between the displacement of the non-magnet member 17*g* and a force acting on the non-magnet member 17*g* when T of FIG. 2A is changed.

FIG. 2C illustrates a result of magnetic field analysis of a relationship between the displacement of the non-magnet member 17*g* and a force acting on the non-magnet member 17*g* when T is 0.5 mm and 0.4 mm under a condition that X=11.0 mm in the magnetic circuit of FIG. 2A. In FIG. 2C, the horizontal axis indicates the displacement of the non-magnetic member 17*g*, and the vertical axis indicates a magnitude of the force acting on the non-magnetic member 17*g*. According to the result of the magnetic field analysis, it is found that, when the thickness of the non-magnet member 17*g* is reduced, the negative stiffness generated by the negative stiffness generating mechanism decreases. Thereby, when the negative stiffness generated by the negative stiffness generating mechanism is reduced by reducing the thickness of the non-magnet member 17*g* and using both the adsorptive material 140 and the negative stiffness generating mechanism, the weight of the vibration system is further reduced, thereby making it possible to improve the efficiency of the loudspeaker apparatus.

Figure 16:
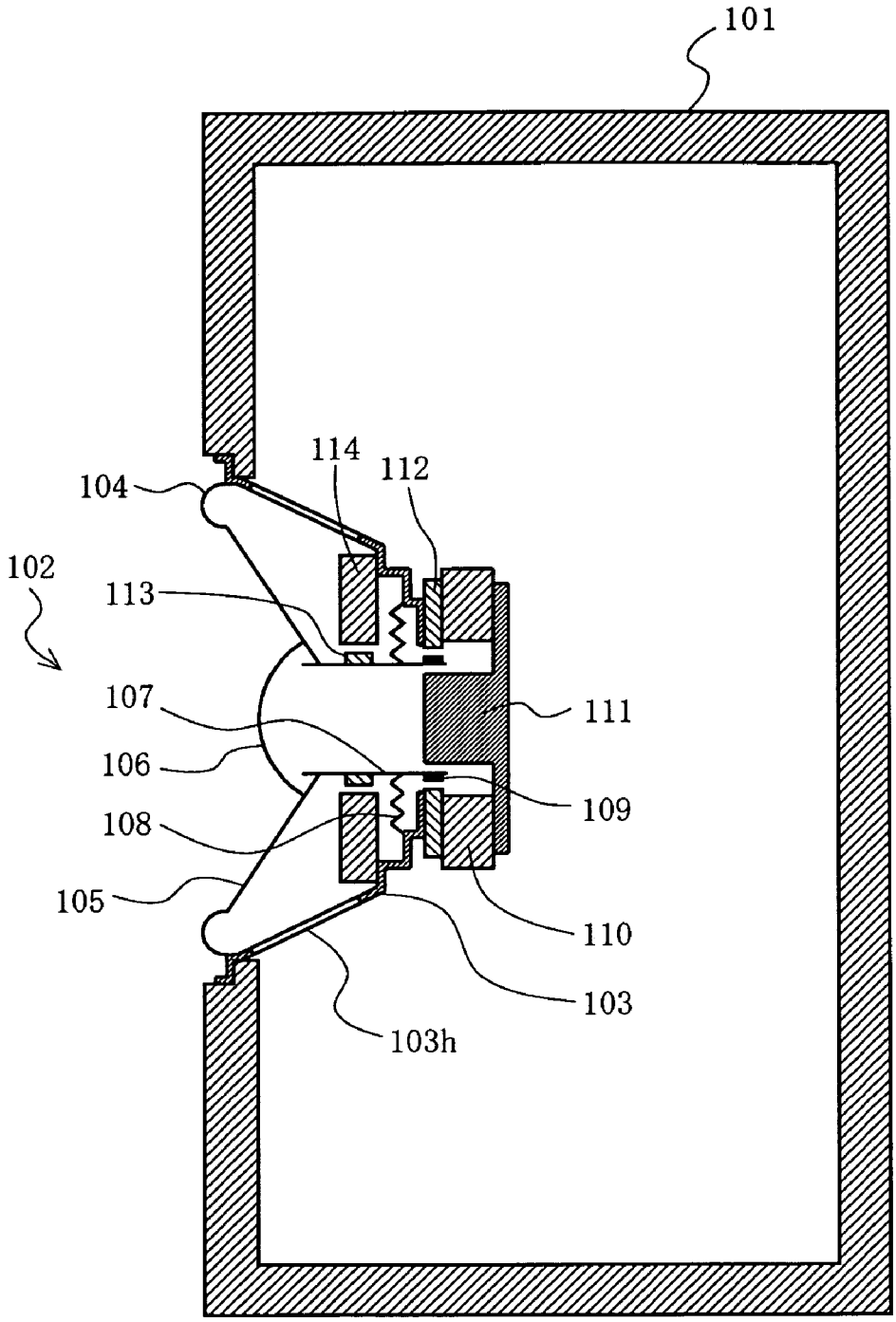
FIG. 16 PRIOR ART
FIG. 16 is a cross-sectional view of a structure of a conventional loudspeaker apparatus.
Figure 17:
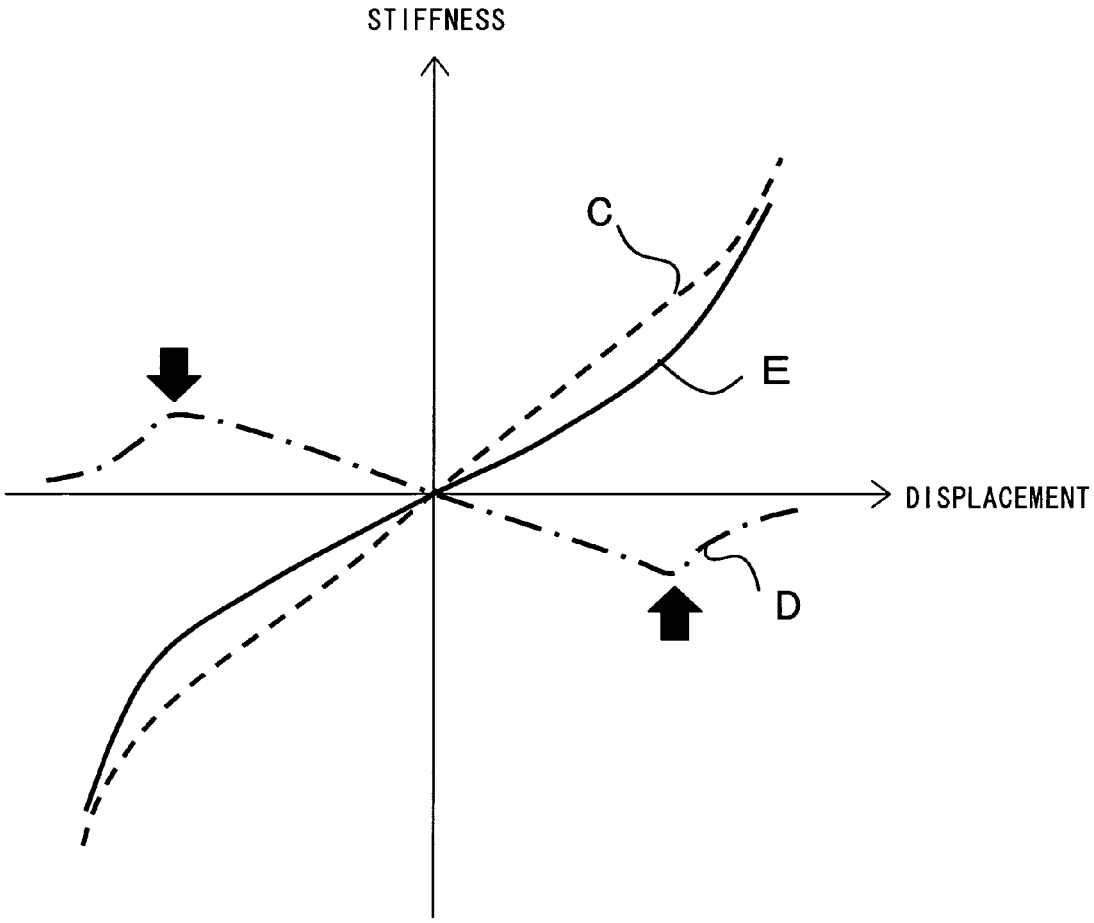
FIG. 17 PRIOR ART
FIG. 17 is a diagram illustrating a relationship between three stiffnesses and a displacement of a movable magnet 113.

Also, in the negative stiffness generating mechanism, repelling force is applied to the non-magnet member 17*g* by magnetic fields formed by the first and second magnetic circuits. Therefore, in the structure, even when a thickness of the non-magnet member 17*g* is reduced to some extent, a sufficient level of repelling force can be generated with respect to the non-magnet member 17*g*. Specifically, in this embodiment, the non-magnet member 17*g* joined with the diaphragm 17 can be made thin, so that the weight of the vibration element can be significantly reduced as compared to a loudspeaker unit which employs the movable magnet 113 of FIG. 16. As a result, in the loudspeaker apparatus of this embodiment, it is possible to suppress a reduction in generated output sound pressure level by providing a negative stiffness generating mechanism inside a loudspeaker unit.

The first magnetic circuit 5 plays a role as an electrokinetic converter, and the negative stiffness generating mechanism shares a portion of the first magnetic circuit 5. Thereby, the loudspeaker apparatus of this embodiment can suppress the size, labor cost, and price cost due to an increase in volume of a magnet, as compared to when a magnetic circuit constituting a negative stiffness generating mechanism is newly provided.

Note that, when the negative stiffness generated in the negative stiffness generating mechanism is excessively large, the diaphragm 17 cannot vibrate, because of remaining pulled by the first magnetic circuit 5 or the second magnetic circuit 10. To prevent this, the negative stiffness generating mechanism is set so that the magnitude of the negative stiffness satisfies the following relationship.

(the negative stiffness of the negative stiffness generating mechanism)≦(the acoustic stiffness of the cabinet 1a)+(the support system stiffness)−(the reduced amount of the acoustic stiffness due to the adsorptive material 140)

Although the loudspeaker unit 2*a* is in the shape of a cylinder in the above description, the present invention is not limited to this. For example, the loudspeaker unit 2*a* may have other shapes, such as an elliptical shape, a rectangular shape, or the like. Alternatively, the loudspeaker unit 2*a* may be in the shape of a racetrack in which only two opposite sides of a rectangle are replaced with semicircles (hereinafter referred to as a track shape). The rectangular shape may be a landscape shape (wider than it is tall). The shapes of the magnet, the yoke, the magnetic plate, and the diaphragm included in the loudspeaker unit 2*a* may be set as appropriate so as to fit the shape of the loudspeaker unit 2*a*. For example, when the loudspeaker unit is in the shape of a rectangle, the diaphragm may be in the shape of a rectangle, and the magnet may be in the shape of a rectangular prism. Although the loudspeaker apparatus of this embodiment is of the closed-box type in FIG. 1, the present invention is not limited to this. For example, the loudspeaker apparatus may be of other types, such as the bass-reflex type, the drone-cone type, and the like.

Although the first and second voice coils 19 and 21 are used in the above description, either of the voice coils may be removed. In this case, a magnetic gap may not be formed in a magnetic circuit from which a voice coil is removed (the first magnetic circuit 5 or the second magnetic circuit 6). Specifically, for example, a magnetic circuit which is composed only of a yoke and a magnet and does not form a magnetic gap may be used.

Note that the loudspeaker apparatus of FIG. 1 may further comprise a support member (not shown) which is provided in the cabinet 1*a* so as to partition between the loudspeaker unit 2*a* and the adsorptive material 140 and supports the adsorptive material 140. The support member is composed of, for example, a cloth, a film, a plate-shaped member, or like. As the cloth, a cloth in which a gap between a fiber and a fiber is smaller than a grain or a fiber of the adsorptive material 140, may be used. For example, when the support member is a film, an outer circumference of the support member is fixed between the adsorptive material 140 and the loudspeaker unit 2*a*. In this case, sound pressure generated from the loudspeaker unit 2*a* is transferred via the support member to the adsorptive material 140. By providing the support member so as to partition between the adsorptive material 140 and the loudspeaker unit 2*a* in this manner, the adsorptive material 140 can be supported while not contacting the loudspeaker unit 2*a*. As a result, it is possible to prevent noise and malfunction which are otherwise caused by grains and the like of the adsorptive material 140 contacting the vibration elements including the diaphragm 17. Also, it is possible to prevent electrical short circuit which is otherwise caused by the adsorptive material 140 contacting an input terminal (not shown) or the like of the loudspeaker unit 2*a*. Note that the support member may be a cloth or a film which is formed in the shape of a bag. In this case, the adsorptive material 140 is provided in the bag-shaped support member. Alternatively, when the support member is a plate-shaped member, the support member may be fixedly provided between the loudspeaker unit 2*a* and the adsorptive material 140. Note that, since sound pressure needs to be transferred to the adsorptive material 140, the plate-shaped member is fixedly provided in a manner which does not completely partition between the adsorptive material 140 and the loudspeaker unit 2*a*.

Second Embodiment

Figure 3:
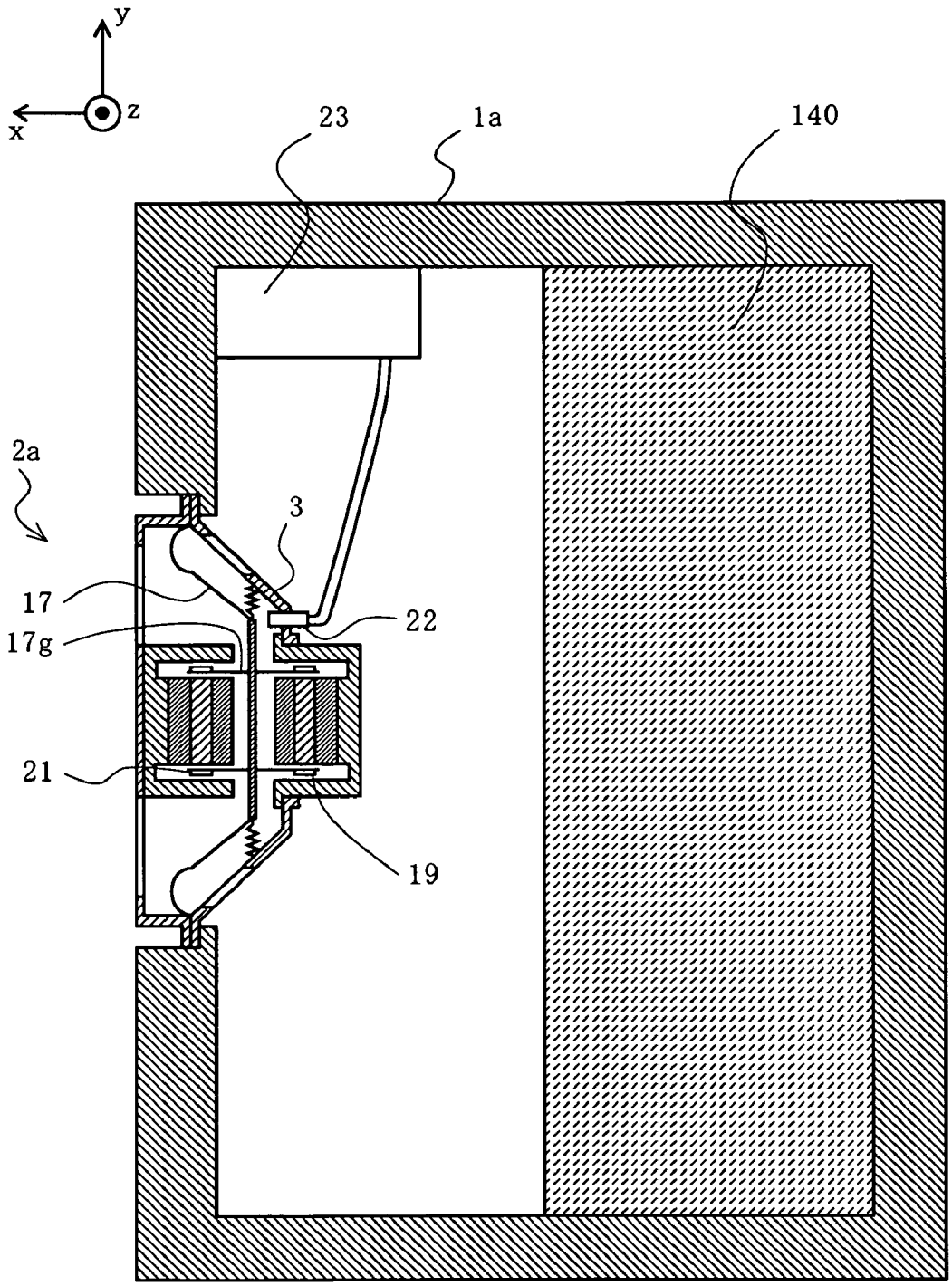
FIG. 3 is a cross-sectional view of a structure of a loudspeaker apparatus of a second embodiment of the present invention.
Figure 4:
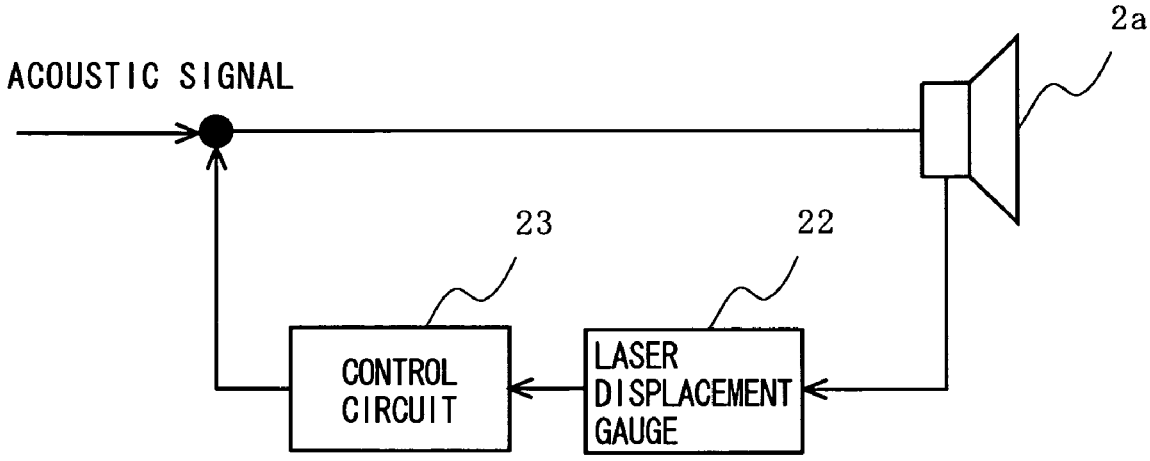
FIG. 4 is a circuit block diagram of the loudspeaker apparatus of the second embodiment.

A loudspeaker apparatus according to a second embodiment of the present invention will be described with reference to FIG. 3. The loudspeaker apparatus of this embodiment is different from that of the first embodiment in that a laser displacement gauge and a control circuit are newly provided. Hereinafter, a difference point will be mainly described. Note that FIG. 3 is a cross-sectional view of a structure of the loudspeaker apparatus of the second embodiment. FIG. 4 is a circuit block diagram of the loudspeaker apparatus of the second embodiment. In FIG. 3, the loudspeaker apparatus of this embodiment roughly comprises a cabinet 1*a*, a loudspeaker unit 2*a*, a laser displacement gauge 22, and a control circuit 23. Note that, since the loudspeaker unit 2*a* is similar to that of the first embodiment, is referenced with the same reference numeral as that of the first embodiment, and will not be described in detail.

In FIG. 4, the laser displacement gauge 22 detects a displacement in a vibration direction (front-to-back surface direction) of the diaphragm 17, and outputs a detected signal to the control circuit 23. In FIG. 3, for example, the laser displacement gauge 22 is placed in the back surface frame 3, and is connected via a wire to the control circuit 23. Note that the laser displacement gauge 22 may be placed in, for example, the front surface frame 4, the cabinet 1*a*, or the like as long as it can detect the displacement of the diaphragm 17. The displacement of the diaphragm 17 may be detected using, for example, a method in which a small magnet is fixed to the diaphragm 17 and a position is detected using a Hall element, in addition to the method of using the laser displacement gauge.

In FIG. 4, the control circuit 23 generates a control signal which causes a center of an amplitude of the non-magnet member 17*g* to be placed at the balanced position in the gap formed between the first and second magnetic circuits 5 and 6, based on the displacement of the diaphragm 17 detected by the laser displacement gauge 22. The control signal generated by the control circuit 23 is added to an input acoustic signal. The input acoustic signal and the control signal are amplified as appropriate by an amplifier or the like, and resultant signals are input to the loudspeaker unit 2*a*. Note that the control signal is, for example, a direct-current electrical signal which corrects a deviation from the balanced position of the non-magnet member 17*g*, or the like. In FIG. 3, the control circuit 23 is provided inside the cabinet 1*a*, and is connected via a wire to each of an input terminal of the loudspeaker unit 2*a* and the laser displacement gauge 22. Alternatively, the control circuit 23 may be provided outside the cabinet 1*a*.

Here, it is assumed that temperature inside the cabinet 1*a* increases. The first and second voice coils 19 and 21 generate heat when a current flows therethrough. When the temperature inside the cabinet 1*a* increases due to the heat generation of the first and second voice coils 19 and 21, the air inside the cabinet 1*a* is expanded or compressed, so that the internal pressure is changed. Due to the pressure change, force is applied to the diaphragm 17, so that the amplitude center of the non-magnet member 17*g* is deviated from the balanced position. The repelling force applied to the non-magnet member 17*g* is symmetrical in the vibration direction with reference to the balanced position. Therefore, when the amplitude center of the non-magnet member 17*g* is deviated from the balanced position, the symmetry of the repelling force is excessively deteriorated, so that a reduction in sound pressure and a distortion occur in reproduced sound. Note that, when the deviation from the balanced position is significant, the diaphragm 17 cannot vibrate, because of remaining pulled by the first magnetic circuit 5 or the second magnetic circuit 10. However, in this embodiment, in the control circuit 23, a control signal which allows the amplitude center of the non-magnet member 17*g* to be placed at the balanced position, is generated, and is added to an input acoustic signal. Thereby, the diaphragm 17 can perform a stable operation in which the amplitude center of the non-magnet member 17*g* is placed at the balanced position, irrespective of a change in ambient environments, such as a change in temperature or the like. As a result, the loudspeaker apparatus of this embodiment can further suppress occurrence of a reduction in sound pressure and a distortion, thereby making it possible to provide high sound quality, as compared to the loudspeaker apparatus of the first embodiment.

Also, in order to expand a low-frequency reproduction band, a stronger magnet needs to be used as a magnet (the second magnets 9 and 14) which is used in the negative stiffness generating mechanism so that the repelling force applied to the non-magnet member 17*g* is increased. In this case, in the control performed by the control circuit 23, it is necessary to increase the force applied to the non-magnet member 17*g* due to the control signal generated by the control circuit 23. In other words, the control signal generated by the control circuit 23 needs to be a large direct-current electrical signal. In this case, a large direct current flows through the first and second voice coils 19 and 21, so that the first and second voice coils 19 and 21 are likely to be cut if they are made of a thin wire material. However, if the first and second voice coils 19 and 21 are made of a thick wire material, the vibration weight increases, resulting in a reduction in efficiency. Also, when the control is performed using a large direct current, the sizes and the cost of circuit elements constituting the control circuit 23 increase. In contrast to this, according to the loudspeaker apparatus of this embodiment, when it is attempted to increase the low-frequency reproduction band by the same amount as that of the conventional art, a small negative stiffness which is generated by the negative stiffness generating mechanism can be used as compared to the conventional art. In other words, the repelling force is small as compared to the conventional art. Thereby, in the loudspeaker apparatus of this embodiment, the direct current for the control can be reduced, thereby making it possible to prevent a reduction in efficiency and increases in size and cost.

Note that the laser displacement gauge 22 and the control circuit 23 may be attached to loudspeaker apparatuses according to fifth to seventh embodiments of the present invention described below, in addition to the loudspeaker apparatus of the first embodiment. Thereby, it is possible to provide a high sound quality loudspeaker apparatus which can suppress occurrence of a reduction in sound pressure and a distortion which are caused by a change in ambient environments.

Third Embodiment

Figure 5:
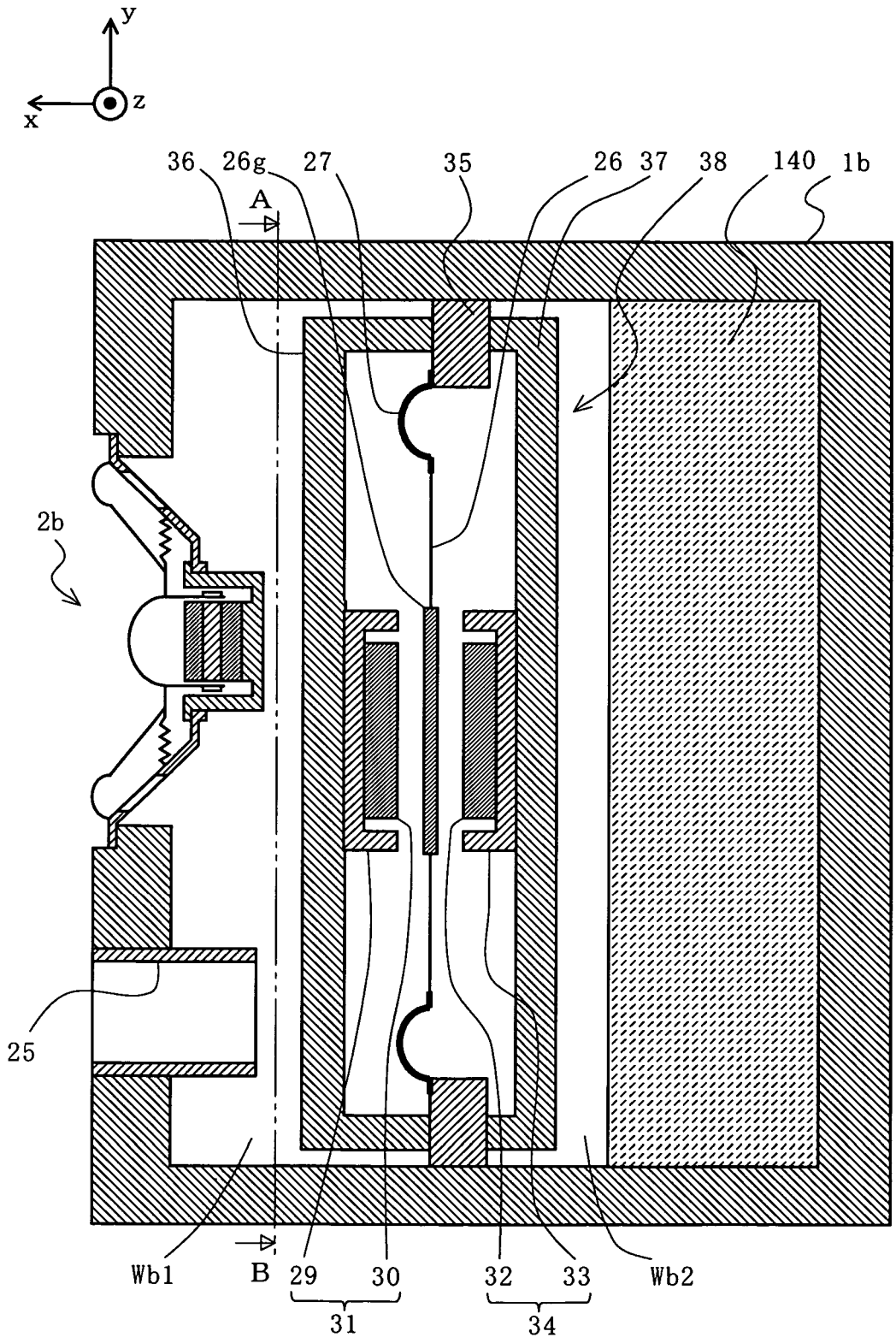
FIG. 5 is a cross-sectional view of a structure of a loudspeaker apparatus of a third embodiment of the present invention.
Figure 6:
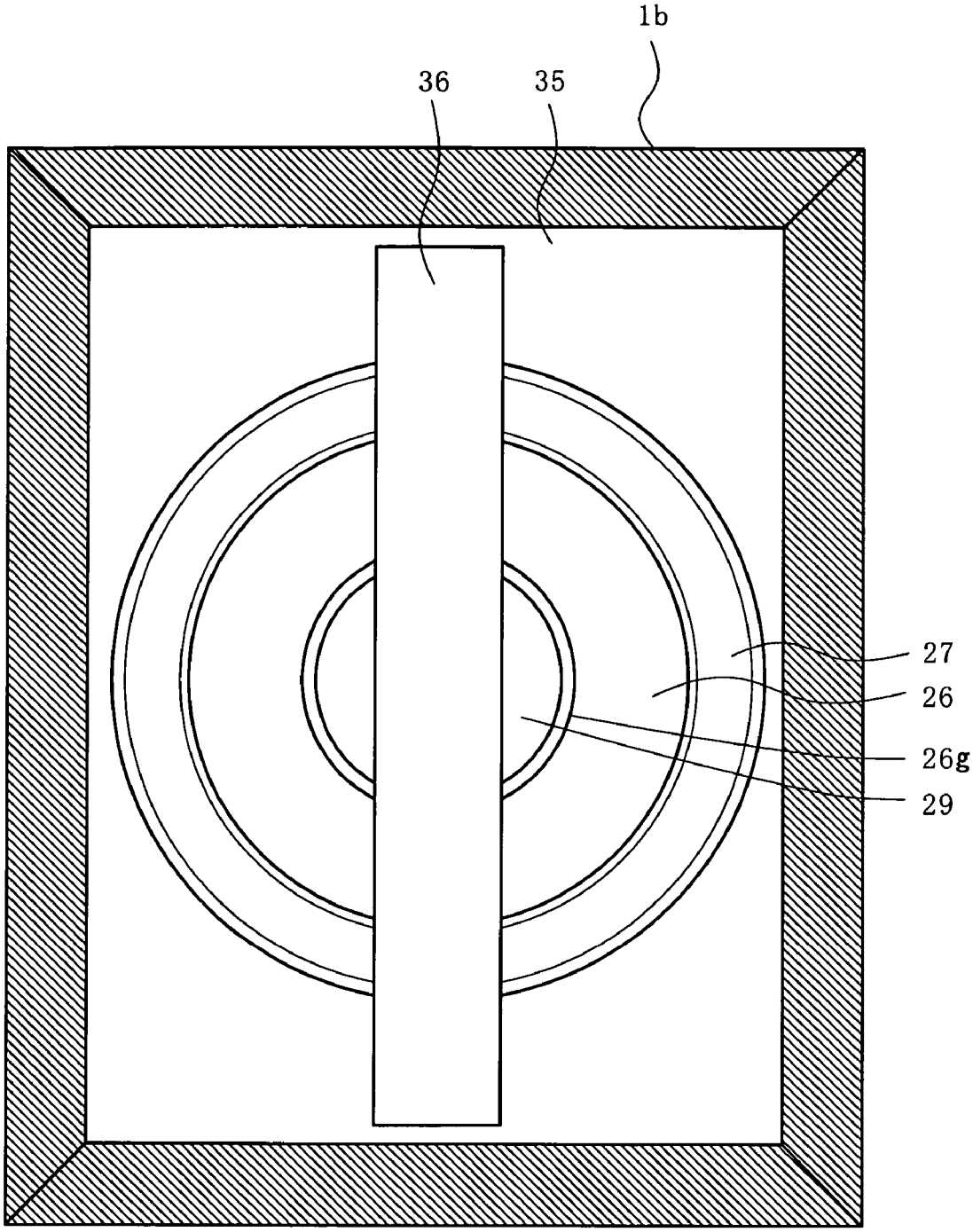
FIG. 6 is a cross-sectional view of the loudspeaker apparatus, taken along dash-dot-dot line A-B of FIG. 5, as viewed from the positive direction of an x axis.

A loudspeaker apparatus according to a third embodiment of the present invention will be described with respect to FIGS. 5 and 6. In the loudspeaker apparatus of this embodiment, a negative stiffness generating mechanism is provided separately from a loudspeaker unit. FIG. 5 is a cross-sectional view of a structure of the loudspeaker apparatus of the third embodiment. FIG. 6 is a cross-sectional view of the loudspeaker apparatus, taken along dash-dot-dot line A-B of FIG. 5, as viewed from the positive direction of the x axis.

In FIG. 5, the loudspeaker apparatus of this embodiment roughly comprises a cabinet 1*b*, a loudspeaker unit 2*b*, an adsorptive material 140, a port 25, and a negative stiffness generating mechanism 38. The loudspeaker unit 2*b* is attached to an opening formed in a front surface (the positive direction of the x axis) of the cabinet 1*b*. The loudspeaker unit 2*b* is, for example, a typical electrokinetic loudspeaker. The cabinet 1*b* is a housing which gives an acoustic stiffness to a diaphragm of the loudspeaker unit 2*b*. The port 25 is attached to the front surface of the cabinet 1*b*. The negative stiffness generating mechanism 38 is fixedly provided in the cabinet 1*b*. Note that an empty room in internal space of the cabinet 1*b* which is closer to a front surface of the negative stiffness generating mechanism 38, is referred to as a first empty room Wb1. An empty room which is closer to a back surface of the negative stiffness generating mechanism 38 is referred to as a second empty room Wb2. The adsorptive material 140 is provided in the second empty room Wb2. Note that the adsorptive material 140 is similar to that of the first embodiment. The loudspeaker apparatus of this embodiment is, for example, of the bass-reflex type which utilizes an acoustic load of the port 25.

The negative stiffness generating mechanism 38 comprises a drone cone 26, an edge 27, a first magnetic circuit 31, a second magnetic circuit 34, a partition 35, a first support member 36, and a second support member 37. The partition 35 is a plate-shaped member, and is fixedly provided in the cabinet 1*b*. The partition 35 divides the internal empty room of the cabinet 1*b* into the first empty room Wb1 and the second empty room Wb2. An opening is formed in a center portion of the partition 35. The first support member 36 is fixedly provided on a front surface (the positive direction of the x axis of FIG. 5) of the partition 35. The second support member 37 is fixedly provided on a back surface (the negative direction of the x axis of FIG. 5) of the partition 35. The first magnetic circuit 31 is fixedly provided on a center portion of a back surface of the first support member 36. The second magnetic circuit 34 is fixedly provided on a center portion of a front surface of the second support member 37, and is positioned, facing the first magnetic circuit 31 via a gap. The first and second magnetic circuits 31 and 34 are in the shape of, for example, a cylinder. The second magnetic circuit 34 is positioned so that a center axis thereof coincides with a center axis of the first magnetic circuit 31. At least a portion of the drone cone 26 is composed of a non-magnet member 26*g*. The drone cone 26 is provided in a gap between the first magnetic circuit 31 and the second magnetic circuit 34. An outer circumference of the edge 27 is fixed to the opening formed in the partition 35. An inner circumference of the edge 27 is fixed to an outer circumference of the drone cone 26. The edge 27 is a support element (suspension) which supports the drone cone 26 in a manner which allows the non-magnet member 26*g* to vibrate in a gap between the first magnetic circuit 31 and the second magnetic circuit 34. Note that the drone cone 26 and the edge 27 may be integrated together. In this embodiment, the drone cone 26 and the support element constitute a vibration section.

The first magnetic circuit 31 has a yoke 29 and a magnet 30. The yoke 29 has a side surface in the shape of, for example, a cylinder, a bottom surface which is formed at one end of the side surface, and an opening which is formed at the other end. The bottom surface of the yoke 29 is fixed to a center portion of a back surface of the first support member 36. The magnet 30 is fixed to a center portion of an inner bottom surface of the yoke 29. A gap is formed between an outer circumferential surface of the magnet 30 and an inner cylindrical surface of the yoke 29. The second magnetic circuit 34 has a yoke 33 and a magnet 32. The yoke 33 has the same shape as that of the yoke 29. The bottom surface of the yoke 33 is fixed to a center portion of a front surface of the second support member 37. The magnet 32 is fixed to a center portion of an inner bottom surface of the yoke 33. A gap is formed between an outer circumferential surface of the magnet 32 and an inner cylindrical surface of the yoke 33. The magnets 30 and 32 are each magnetized in a vibration direction (the x-axis direction) of the drone cone 26. Note that the magnets 30 and 32 may have the same or opposite magnetization directions.

The drone cone 26 is a diaphragm in the shape of, for example, a disc, and is composed of the non-magnet member 26*g*. The material, size, and position of the non-magnet member 26*g* are similar to those of the non-magnet member 17*g*, and will not be described. A joint structure of the non-magnet member 26*g* and the drone cone 26 is similar to that of the first embodiment, and will not be described.

Next, an operation of the loudspeaker apparatus of this embodiment will be described. When an electrical signal is applied to the loudspeaker unit 2*b*, sound pressure is generated. The sound pressure generated in the loudspeaker unit 2*b* vibrates, via the first empty room Wb1, the drone cone 26 in the x-axis direction. Due to the vibration of the drone cone 26, pressure in the second empty room Wb2 changes. However, since the adsorptive material 140 is provided in the second empty room Wb2, a change in pressure in the second empty room Wb2 is suppressed by physical adsorption action of the adsorptive material 140. Thereby, the acoustic stiffness of the second empty room Wb2 is reduced. A reduction in acoustic stiffness of the second empty room Wb2 leads to a reduction in acoustic stiffness of the first empty room Wb1 as viewed from the loudspeaker unit 2*b*. In other words, the adsorptive material 140 plays a role in reducing the acoustic stiffness of the whole cabinet 1*a* by suppressing a change in pressure in the second empty room Wb2.

On the other hand, in the negative stiffness generating mechanism 38, the drone cone 26 vibrates in the gap between the first magnetic circuit 31 and the second magnetic circuit 34. The vibration direction of the drone cone 26 is the front-to-back surface direction (the x-axis direction). In this case, pulling force in the vibration direction is alternately applied to the non-magnet member 26*g* by magnetic fields formed by the first and second magnetic circuits 31 and 34, depending on the vibration of the diaphragm 26. In other words, in this embodiment, the first magnetic circuit 31, the second magnetic circuit 34, and the non-magnet member 26*g* play a role in generating a negative stiffness. Here, the first magnetic circuit 31, the second magnetic circuit 34, and the non-magnet member 26*g* which generate a negative stiffness in the negative stiffness generating mechanism 38, constitute a repelling force generating section. Specifically, the repelling force generating section in the negative stiffness generating mechanism 38 reduces the acoustic stiffness in the second empty room Wb2. A reduction in acoustic stiffness of the second empty room Wb2 leads to a reduction in acoustic stiffness of the first empty room Wb1 as viewed from the loudspeaker unit 2*b*. Thus, the negative stiffness generating mechanism 38 reduces the acoustic stiffness of the whole cabinet 1*b*.

As described above, in this embodiment, the acoustic stiffness of the cabinet 1*b* is reduced by action of each of the adsorptive material 140, and the negative stiffness generating mechanism 38 provided separately from the loudspeaker unit. A reduction in the acoustic stiffness equivalently increases the volume of the cabinet 1*b*. As a result, a load to the negative stiffness generating mechanism 38 is reduced, so that the operation of the negative stiffness generating mechanism 38 is stabilized, thereby making it possible to further expand a low-frequency sound reproduction band.

Note that, in the above-described repelling force generating section, the vibrating portion is composed of a non-magnet member (the non-magnet member 26*g*) and the fixed portion is composed of a magnet (the magnets 30 and 32), or alternatively, the vibrating portion may be composed of a magnet and the fixed portion may be composed of a non-magnet member. In this case, magnetic pulling force is generated between the magnet and the non-magnet, so that a similar effect is obtained. Alternatively, both the vibrating portion and the fixed portion may be composed of a magnet. In this case, all the magnets of the vibrating portion and the fixed portion have the same magnetization direction. Although the first magnetic circuit 31 and the second magnetic circuit 34 each have a yoke and a magnet in the above description, only a magnet may be used.

Although the drone cone 26 is in the shape of a disc in the above description, the present invention is not limited to this. The drone cone 26 may be in the shape of, for example, an ellipse, a rectangle, a track, or the like. The rectangular shape may be a landscape shape (wider than it is tall). Although the first and second magnetic circuits 31 and 34 are in the shape of a cylinder in the above description, the present invention is not limited to this. The first and second magnetic circuits 31 and 34 may be in the shape of, for example, an ellipse, a rectangle, a track, or the like. The first and second magnetic circuits 31 and 34 are of the inner magnet type in the above description, or alternatively, may be of the outer magnet type. The first and second support members 36 and 37 are not limited to the above-described shapes, and may be in any shape which can support the first and second magnetic circuits 31 and 34 in a manner which allows the first and second magnetic circuits 31 and 34 to be positioned, facing each other via a gap. Although the loudspeaker apparatus of this embodiment illustrated in FIG. 5 is of the bass-reflex type, the present invention is not limited to this. For example, the loudspeaker apparatus of this embodiment may be of other types, such as the closed-box type, the drone-cone type, and the like.

Fourth Embodiment

A loudspeaker apparatus according to a fourth embodiment of the present invention will be described with reference to FIG. 7. In the fourth embodiment, a low-frequency sound enforcing apparatus which is a unit of the negative stiffness generating mechanism 38 and the adsorptive material 140 is provided in a general conventional loudspeaker apparatus, thereby expanding a low-frequency sound reproduction band of the loudspeaker apparatus. Note that FIG. 7 is a cross-sectional view of a structure of the conventional loudspeaker apparatus and the low-frequency sound enforcing apparatus provided in the loudspeaker apparatus.

Figure 7:
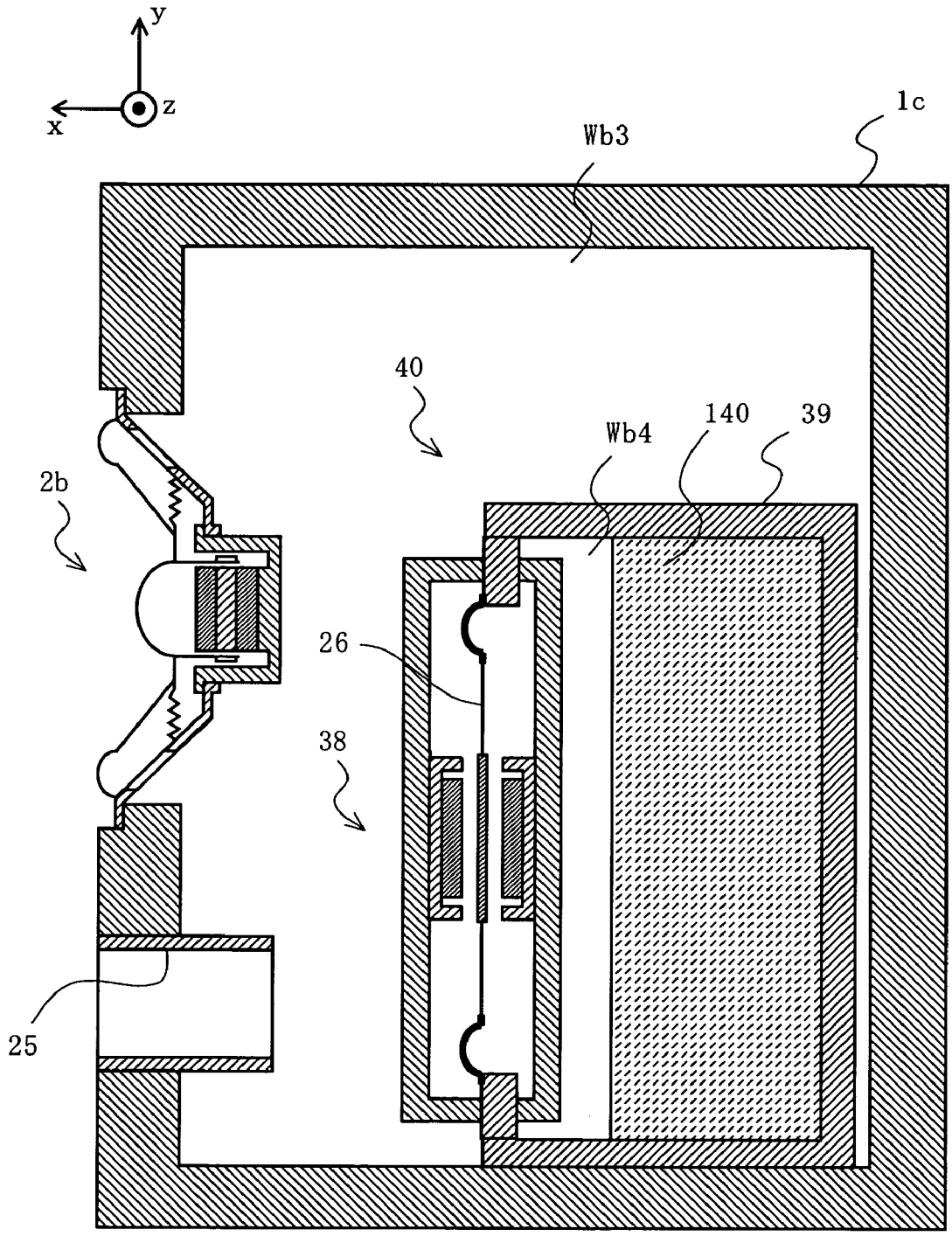
FIG. 7 is a cross-sectional view of a structure of a conventional loudspeaker apparatus and a low-frequency sound enforcing apparatus provided in the loudspeaker apparatus.

In FIG. 7, the loudspeaker apparatus of this embodiment roughly comprises a cabinet 1*c*, a loudspeaker unit 2*b*, a port 25, and a low-frequency sound enforcing apparatus 40. The loudspeaker unit 2*b* is attached to an opening formed in a front surface of the cabinet 1*c*. The loudspeaker unit 2*b* is, for example, a typical electrokinetic loudspeaker. The cabinet 1*c* is a housing which gives an acoustic stiffness to a diaphragm of the loudspeaker unit 2*b*. The port 25 is attached to a front surface of the cabinet 1*c*. The low-frequency sound enforcing apparatus 40 is provided in the cabinet 1*c*. Note that an empty room which is present inside the cabinet 1*c* and outside the low-frequency sound enforcing apparatus 40 is referred to as a first empty room Wb3. The loudspeaker apparatus of this embodiment is, for example, a bass-reflex type loudspeaker apparatus which utilizes an acoustic load of the port 25.

The low-frequency sound enforcing apparatus 40 has a cabinet 39, an adsorptive material 140, and a negative stiffness generating mechanism 38. The negative stiffness generating mechanism 38 is attached to an opening formed in the cabinet 39. The negative stiffness generating mechanism 38 is similar to that of the third embodiment. The adsorptive material 140 is provided in the cabinet 39. The adsorptive material 140 is similar to that of the first embodiment. Here, an internal empty room of the cabinet 39 is referred to as a second empty room Wb4. The low-frequency sound enforcing apparatus 40 does not need to be fixed with respect to the loudspeaker apparatus, and may be placed at any position which allows the negative stiffness generating mechanism 38 to contact the first empty room Wb3.

Next, an operation of the loudspeaker apparatus of this embodiment will be described. When an electrical signal is applied to the loudspeaker unit 2*b*, sound pressure is generated. The sound pressure generated in the loudspeaker unit 2*b* vibrates, via the first empty room Wb3, the drone cone 26 in the x-axis direction. The vibration of the drone cone 26 changes pressure in the second empty room Wb4. However, since the adsorptive material 140 is provided in the second empty room Wb4, a change in pressure in the second empty room Wb4 is suppressed by physical adsorption action of the adsorptive material 140. As a result, the acoustic stiffness of the second empty room Wb4 is reduced. A reduction in acoustic stiffness of the second empty room Wb4 leads to a reduction in acoustic stiffness of the first empty room Wb3 as viewed from the loudspeaker unit 2*b*. In other words, the adsorptive material 140 suppresses a change in pressure in the second empty room Wb4, thereby playing a role in reducing the acoustic stiffness of the whole cabinet 1*c*.

On the other hand, as described in the third embodiment, the acoustic stiffness of the second empty room Wb4 is reduced due to the negative stiffness generating mechanism 38. Thereby, the acoustic stiffness of the whole cabinet 1 is reduced due to the negative stiffness generating mechanism 38.

As described above, in this embodiment, by providing the low-frequency sound enforcing apparatus 40 inside conventional loudspeaker apparatuses, the reproduction limit of a low-frequency sound region of the loudspeaker apparatus can be easily extended. Specifically, only by providing the low-frequency sound enforcing apparatus 40 of the present invention inside a loudspeaker apparatus possessed by a user, the low-frequency sound of the current loudspeaker system can be enhanced. Although the bass-reflex type loudspeaker apparatus has been described above, the present invention is not limited to this. For example, the loudspeaker apparatus of this embodiment may be of other types, such as the closed-box type, the drone-cone type, and the like.

Fifth Embodiment

Figure 8:
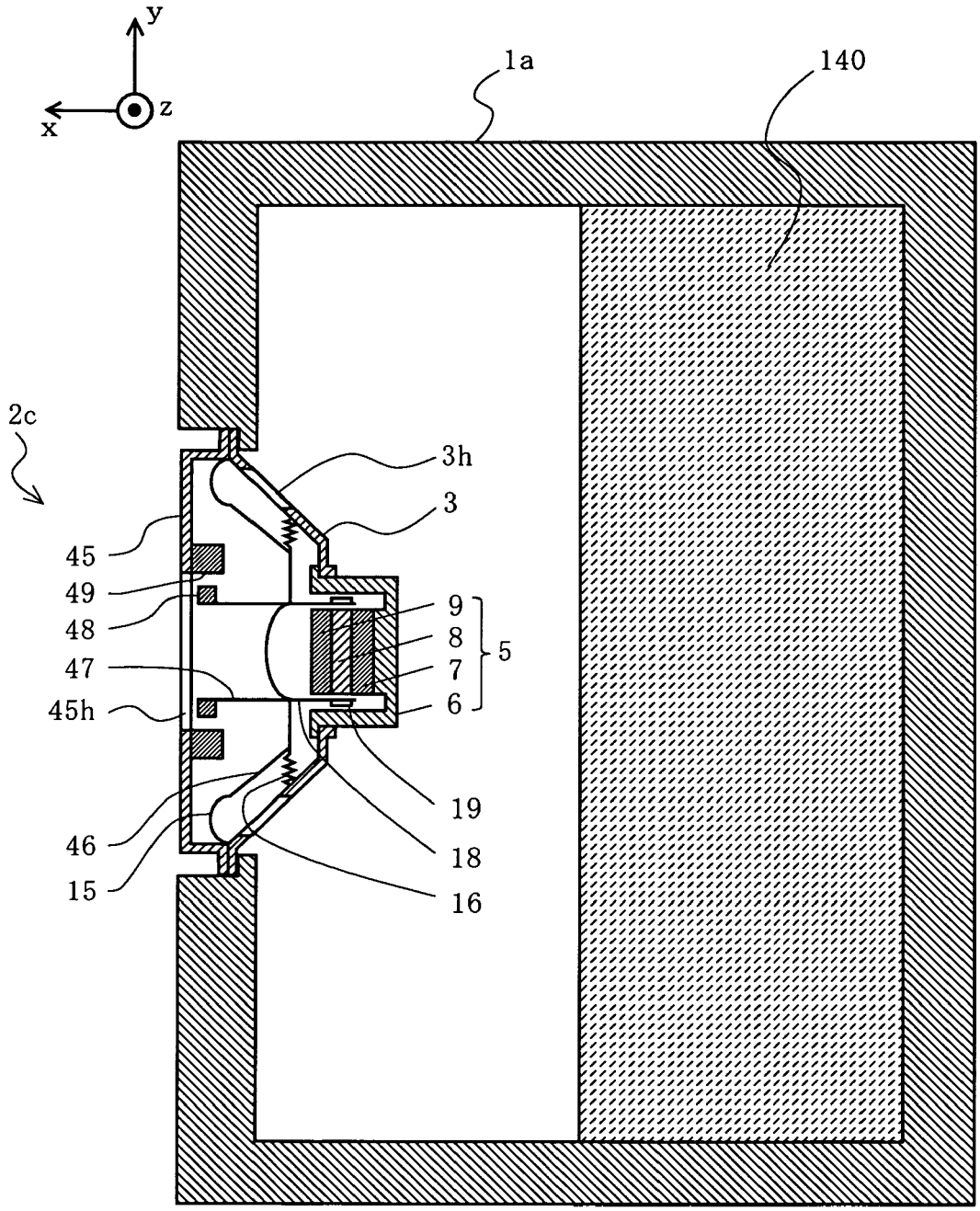
FIG. 8 is a cross-sectional view of a structure of a loudspeaker apparatus of a fifth embodiment of the present invention.

A loudspeaker apparatus according to a fifth embodiment of the present invention will be described with reference to FIG. 8. The loudspeaker apparatus of this embodiment is different from that of the first embodiment in the configuration of the negative stiffness generating mechanism. Hereinafter, a difference will be mainly described. FIG. 8 is a cross-sectional view of a structure of the loudspeaker apparatus of the fifth embodiment. In FIG. 8, the loudspeaker apparatus roughly comprises a cabinet 1*a*, a loudspeaker unit 2*c*, and an adsorptive material 140. Note that the loudspeaker apparatus of this embodiment is of, for example, the closed-box type.

The loudspeaker unit 2*c* is in the shape of, for example, a circle, and is attached to an opening formed in a front surface (the positive direction of the x axis of FIG. 8) of the cabinet 1*a*. The cabinet 1*a* is a housing which gives an acoustic stiffness to a diaphragm of the loudspeaker unit 2*c*. The adsorptive material 140 is provided inside the cabinet 1*a*.

In FIG. 8, the loudspeaker unit 2*c* has a back surface frame 3, a front surface frame 45, a first magnetic circuit 5, an edge 15, a damper 16, a diaphragm 46, a first voice coil bobbin 18, a first voice coil 19, a support member 47, a movable magnet 48, and a fixed magnet 49. Note that the back surface frame 3, the first magnetic circuit 5, the edge 15, the damper 16, the diaphragm 17, the first voice coil bobbin 18, and the first voice coil 19 are similar to those of the first embodiment, are referenced with the same reference numerals, and will not be described. The front surface frame 45 is the same as the front surface frame 4, except for the shape. Specifically, a sound hole 45*h* (circular opening) is formed in a center portion of the front surface frame 45. The first voice coil bobbin 18 is fixedly provided to the diaphragm 46. A portion located farther inside than the fixed portion of the diaphragm 46 has a shape different from that of first embodiment. In this embodiment, the diaphragm 46, the first voice coil bobbin 18, the first voice coil 19, the support member 47, and the movable magnet 48 constitute a vibration element which is vibrated by driving force generated in the first voice coil 19. The edge 15 and the damper 16 constitute a support element which supports the vibration element. The vibration element and the support element constitute a vibration section.

In FIG. 8, the movable magnet 48 and the fixed magnet 49 play a role as a negative stiffness generating mechanism. A support member 43 is a cylindrical member which is fixed to a center portion of a front surface of the diaphragm 46. The movable magnet 48 is in the shape of a ring. An inner circumferential surface of the movable magnet 48 is fixedly provided on an outer circumferential surface of the support member 47. The fixed magnet 49 is in the shape of, for example, a ring which has an inner diameter larger than an outer diameter of the movable magnet 48. The fixed magnet 49 is fixed to a back surface of the front surface frame 45 so that an inner circumferential surface of the fixed magnet 49 and an outer circumferential surface of the movable magnet 48 form a gap and face each other via the gap. The movable magnet 48 and the fixed magnet 49 are magnetized to the same polarity in the vibration direction (the x-axis direction).

Next, an operation of the loudspeaker apparatus of this embodiment will be described. When an electrical signal is applied to the first voice coil 19, driving force is generated due to a current flowing through the first voice coil 19 and a magnetic field formed in the magnetic gap. The driving force causes the diaphragm 46 to vibrate in the x-axis direction, thereby generating sound pressure. The above-described operation is an operation of a typical electrokinetic loudspeaker. Here, the physical adsorption action of the adsorptive material 140 is similar to that of the first embodiment and will not be described. Hereinafter, an action of a negative stiffness generating mechanism composed of the movable magnet 48 and the fixed magnet 49 will be described.

The diaphragm 46 is vibrated by the driving force generated in the first voice coil 19. In this case, the movable magnet 48 and the support member 47 vibrate together in an inner circumferential portion of the fixed magnet 49. The movable magnet 48 and the fixed magnet 49 are magnetized in the same direction (the vibration direction), and when they are displaced, magnetic fields which repel each other are generated. Therefore, when the movable magnet 48 is deviated from the balanced position (magnetically balanced position), force which causes the movable magnet 48 to escape from the balanced position is generated. In other words, the movable magnet 48 and the fixed magnet 49 act to provide a negative stiffness in the vibration section of the loudspeaker unit 2*c*, at a position deviated from the balanced position.

As described above, in this embodiment, the acoustic stiffness of the cabinet 1*a* is reduced by action of each of the adsorptive material 140, and the negative stiffness generating mechanism composed of the movable magnet 48 and the fixed magnet 49. Due to a reduction in the acoustic stiffness, the volume of the cabinet 1*a* is equivalently increased. As a result, an effect similar to that of the first embodiment can be obtained.

Also, in this embodiment, even when the amplitude of the diaphragm 46 increases, the movable magnet 48 does not strike the fixed magnet 49. Thereby, the loudspeaker apparatus of this embodiment is useful as a large-input loudspeaker having a large amplitude as well.

Although the loudspeaker unit 2*c* is in the shape of, for example, a circle in the above description, the present invention is not limited to this. The loudspeaker unit 2*c* may have other shapes, such as an elliptical shape, a rectangular shape, or the like. The rectangular shape may be a landscape shape (wider than it is tall). Although the movable magnet 48 and the fixed magnet 49 are in the shape of a ring, and the sound hole 45*h* is in the shape of a circle in the above description, the present invention is not limited to this. For example, it is assumed that, in a landscape-shaped loudspeaker unit 2*c*, a cylindrical member in the shape of a rectangular prism is used as the first voice coil 19. In this case, in a quadrangle formed by the opening of the first voice coil 19, the movable magnet 48 in the shape of a cuboid is fixed to each side of one of the two sets of opposite sides facing each other. The fixed magnet 49 is in the shape of a cuboid, and is provided at a position which faces a corresponding one of the movable magnets 48. The sound hole 45*h* of the front surface frame 45 is a quadrangular opening. Thus, the movable magnet 48, the fixed magnet 49, and the sound hole 45*h* are set as appropriate to fit the shape of the loudspeaker unit 2*c*, and the like. Although the loudspeaker apparatus of this embodiment is of the closed-box type in FIG. 8, the present invention is not limited to this. The loudspeaker apparatus of this embodiment may be of other types, such as the bass-reflex type, the drone-cone type, and the like.

Sixth Embodiment

Figure 9:
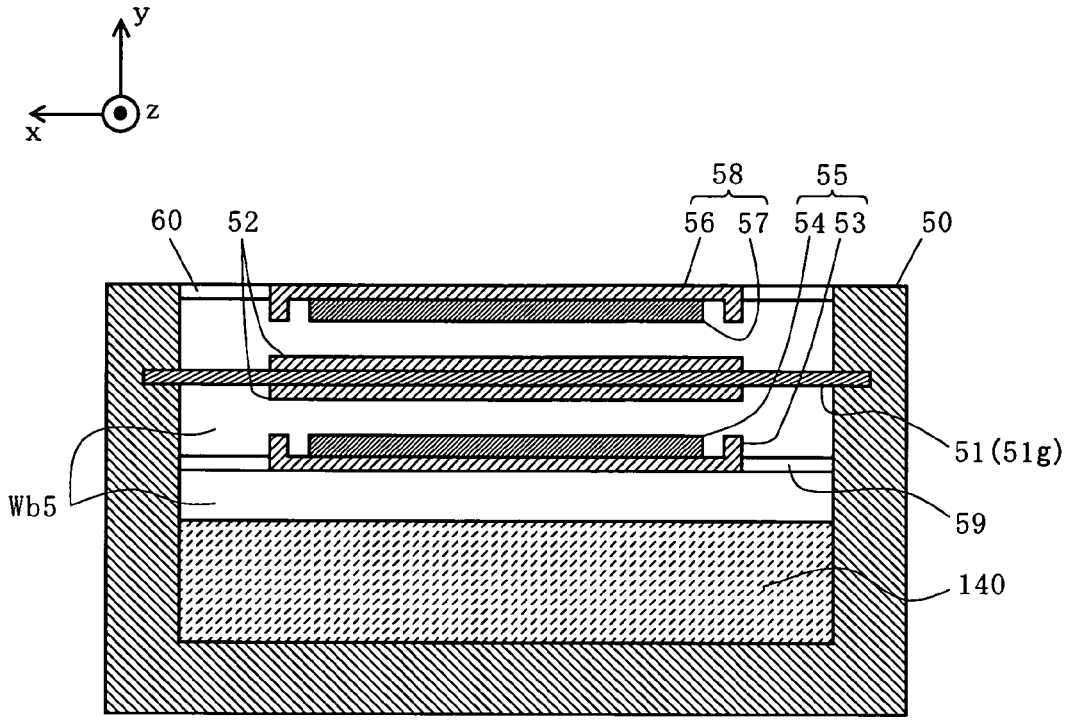
FIG. 9 is a cross-sectional view of a structure of a loudspeaker apparatus of a sixth embodiment of the present invention.

A loudspeaker apparatus according to a sixth embodiment of the present invention will be described with reference to FIG. 9. The loudspeaker apparatus of this embodiment employs a piezoelectric converter as a converter (drive section) for driving a diaphragm (vibration section). FIG. 9 is a cross-sectional view of a structure of the loudspeaker apparatus of the sixth embodiment. Note that FIG. 9 illustrates a closed-box type loudspeaker apparatus. In FIG. 9, the loudspeaker apparatus comprises a frame 50, an adsorptive material 140, a diaphragm 51, a piezoelectric element 52, a first magnetic circuit 55, a second magnetic circuit 58, a first support member 59, and a second support member 60. The adsorptive material 140 is similar to that of the first embodiment, is referenced with the same reference numeral, and will not be described.

In FIG. 9, the loudspeaker apparatus has a circular outer shape, for example. The frame 50 is a housing which has an upper surface (the positive direction of the y axis) in which an opening is formed. The frame 50 is also a housing which gives an acoustic stiffness to the diaphragm 51 described below. The adsorptive material 140 is provided on an inner bottom surface of the frame 50. The first support member 59 is fixed inside the frame 50 and above an upper surface of the adsorptive material 140. A gap is formed between the first support member 59 and the adsorptive material 140. The first magnetic circuit 55 is fixedly provided at a center portion of the first support member 59. The second magnetic circuit 58 is positioned above an upper surface of the first magnetic circuit 55, facing via a gap the first magnetic circuit 55. The second support member 60 is fixed inside the frame 50, and supports the second magnetic circuit 58 at the above-described position. Note that an opening is formed in each of the first and second support members 59 and 60, so that the internal space of the frame 50 is not hermetically confined. At least a portion of the diaphragm 51 is composed of a non-magnet member 51*g*. In FIG. 9, for example, the diaphragm 51 is composed only of the film-shaped non-magnet member 51*g*. Note that the diaphragm 51 may be composed of, for example, a film-shaped vibration film made of a non-magnetic resin, a portion of which is the film-shaped non-magnet member 51*g*. Alternatively, the diaphragm 51 may be composed of, for example, a vibration film made of a non-magnetic resin which is joined with the film-shaped non-magnet member 51*g*. An outer circumference of the diaphragm 51 is fixed inside the frame 50 so that the diaphragm 51 is placed in a gap formed between the first and second magnetic circuits 55 and 58. Note that an internal empty room of the loudspeaker apparatus formed by the diaphragm 51 and the frame 50 is referred to as an empty room Wb5. The piezoelectric element 52 is fixed to both surfaces of the diaphragm 51. A conductor for externally applying an electrical signal to the piezoelectric element 52 is connected to the diaphragm 51. An electrical signal is externally applied via the conductor to the piezoelectric element 52.

The first magnetic circuit 55 has a yoke 53 and a magnet 54. The second magnetic circuit 58 has a yoke 56 and a magnet 57. The first magnetic circuit 55 and the second magnetic circuit 58 have the same configurations as those of the first magnetic circuit 31 and the second magnetic circuit 34, respectively.

Next, an operation of the loudspeaker apparatus of this embodiment will be described. When electrical signals having opposite polarities (positive and negative) are applied to the piezoelectric elements 52 fixed on both the surfaces of the diaphragm 51, respectively, the diaphragm 51 is bent by the piezoelectric element 52, thereby generating sound pressure. This is similar to the operation of typical piezoelectric loudspeakers. The sound pressure generated by the diaphragm 51 changes pressure in the empty room Wb5. However, since the adsorptive material 140 is provided in the empty room Wb5, the pressure change in the empty room Wb5 is suppressed by physical adsorption action of the adsorptive material 140. As a result, the acoustic stiffness of the empty room Wb5 is reduced.

On the other hand, the diaphragm 51 vibrates in the y-axis direction in a gap formed between the first magnetic circuit 55 and the second magnetic circuit 58. In this case, pulling force in the vibration direction is alternately applied to the non-magnet member 51*g* due to magnetic fields formed by the first and second magnetic circuits 55 and 58, depending on the vibration of the diaphragm 51. In other words, in this embodiment, the non-magnet member 51*g* of the diaphragm 51, the first magnetic circuit 55, and the second magnetic circuit 58 play a role as a negative stiffness generating mechanism. Due to the negative stiffness generating mechanism, the acoustic stiffness of the empty room Wb5 is reduced.

As described above, in this embodiment, the piezoelectric loudspeaker apparatus can exhibit an effect similar to that of the first embodiment. Note that the piezoelectric loudspeaker apparatus is widely used as a thin loudspeaker. When the piezoelectric loudspeaker apparatus is used as a thin loudspeaker, it is difficult to secure the amplitude of the diaphragm due to the thinness. In addition, the magnet and the diaphragm of the negative stiffness generating mechanism are positioned close to each other. In this case, the negative stiffness generated by the negative stiffness generating mechanism has a portion in which a nonlinear change occurs with respect to the displacement of the diaphragm. Therefore, in a loudspeaker apparatus composed only of the conventional negative stiffness generating mechanism, it is difficult to exhibit the effect of expanding a low-frequency sound region to a sufficient extent. However, according to this embodiment, by providing the adsorptive material 140 in free space inside the frame 50, the adsorptive material 140 can be caused to share the load of the low-frequency sound region expanding effect. Since the load on the negative stiffness generating mechanism can be reduced, the thickness of the magnet can be reduced, and the distance between the diaphragm and the magnet can be increased even in a loudspeaker apparatus having the same thickness. Therefore, the nonlinear portion of the negative stiffness can be reduced. Thereby, the operation of the negative stiffness generating mechanism is stable and reduced sound having less distortion can be obtained.

Although the loudspeaker apparatus has, for example, a circular outer shape in the above description, the present invention is not limited to this. For example, the outer shape may be an elliptical shape, a rectangular shape, a track shape, or the like. The rectangular shape may be a landscape shape (wider than it is tall). Although a closed-box type loudspeaker apparatus has been described as the loudspeaker apparatus of this embodiment in FIG. 9, the present invention is not limited to this. For example, the loudspeaker apparatus of this embodiment may be of other types, such as the bass-reflex type, the drone-cone type, and the like.

Seventh Embodiment

Figure 10:
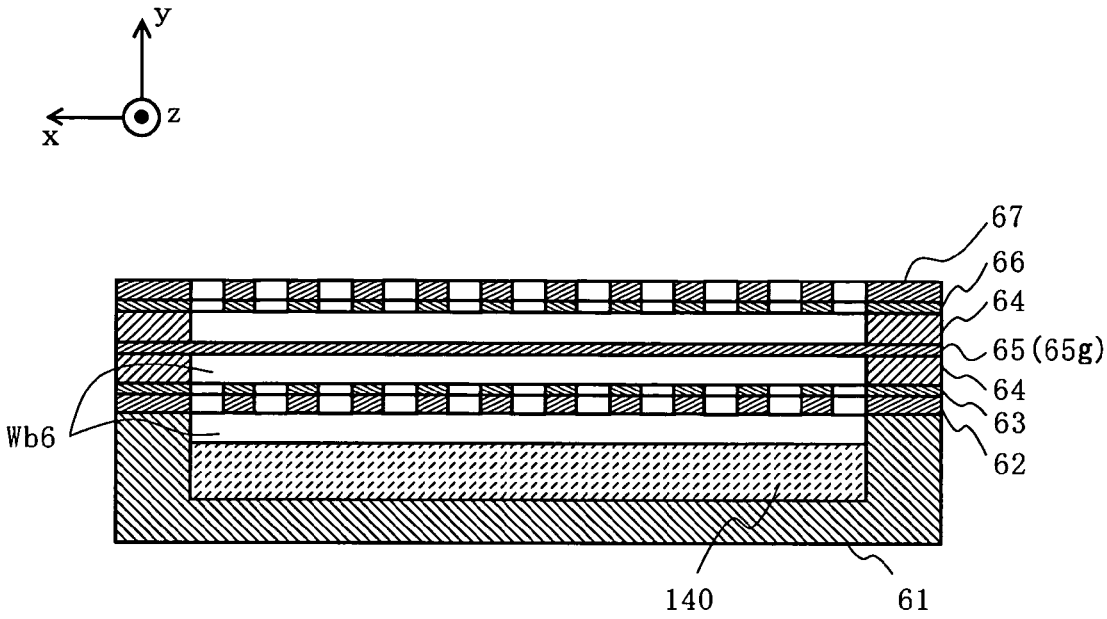
FIG. 10 is a cross-sectional view of a structure of a loudspeaker apparatus of a seventh embodiment of the present invention.

A loudspeaker apparatus according to a seventh embodiment of the present invention will be described with reference to FIG. 10. The loudspeaker apparatus of this embodiment is different from that of the sixth embodiment in that an electrostatic converter is used as a converter (drive section) for driving a diaphragm (vibration section). FIG. 10 is a cross-sectional view of a structure of the loudspeaker apparatus of the seventh embodiment. Note that FIG. 10 illustrates a closed-box type loudspeaker apparatus. In FIG. 10, the loudspeaker apparatus comprises a frame 61, an adsorptive material 140, a first magnet 62, a first electrode 63, a spacer 64, a diaphragm 65, a second electrode 66, and a second magnet 67. The adsorptive material 140 is similar to that of the first embodiment, is referenced with the same reference numeral, and will not be described.

In FIG. 10, the loudspeaker apparatus has a circular outer shape, for example. The frame 61 is a housing which has an upper surface (the positive direction of the y axis) in which an opening is formed. The frame 61 is also a housing which gives an acoustic stiffness to the diaphragm 65 described below. The adsorptive material 140 is provided on an inner bottom surface of the frame 61. The first magnet 62 is a sheet-shaped member in which a number of openings are formed. The first magnet 62 is fixedly provided in an end surface of the opening of the frame 61. The first electrode 63 is a plate-shaped conductive member in which a number of openings are formed. The first electrode 63 is fixedly provided on an upper surface of the first magnet 62. At least a portion of the diaphragm 65 is composed of a non-magnet member 65*g*. In FIG. 10, for example, the diaphragm 65 is composed only of the film-shaped non-magnet member 65*g*. Note that the diaphragm 65 may be composed of, for example, a non-magnetic material of a vibration film made of aluminum, at least a portion of which is composed of the film-shaped non-magnet member 65*g*. Alternatively, the diaphragm 65 may be composed of, for example, an aluminum vibration film, on both surfaces of which the film-shaped non-magnet member 65*g* is joined. The diaphragm 65 is provided above an upper surface of the first electrode 63 via the ring-shaped spacer 64. Note that an empty room formed by the diaphragm 65 and the frame 61 is referred to as an empty room Wb6. The second electrode 66 is a conductive member similar to the first electrode 63. The second electrode 66 is provided above an upper surface of the diaphragm 65 via the spacer 64. The second magnet 67 is a member similar to the first magnet 62. The second magnet 67 is fixedly provided on an upper surface of the second electrode 66. As illustrated in FIG. 10, the spacer 64 is provided between the diaphragm 65 and each electrode (the first and second electrodes 63 and 66) so as to secure the amplitude of the diaphragm 65. In FIG. 10, the second magnet 67 is positioned, facing the first magnet 62 via a gap (a gap including the diaphragm 65, the first electrode 63, and the second electrode 66).

Next, an operation of the loudspeaker apparatus of this embodiment will be described. Initially, a direct voltage is applied between the first and second electrodes 63 and 66 and the diaphragm 65. An acoustic electrical signal is applied to the first and second electrodes 63 and 66 via a transformer (not shown) for impedance match. Thereby, the diaphragm 65 vibrates in the y-axis direction, thereby generating sound pressure. This is similar to the operation of typical electrostatic loudspeakers. The sound pressure generated by the diaphragm 65 changes pressure in the empty room Wb6. However, since the adsorptive material 140 is provided in the empty room Wb6, the pressure change in the empty room Wb6 is suppressed by physical adsorption action of the adsorptive material 140. As a result, the acoustic stiffness of the empty room Wb6 is reduced.

On the other hand, the diaphragm 65 vibrates in the y-axis direction in a gap between the first magnet 62 and the second magnet 67. In this case, pulling force in vibration direction is alternately applied to the non-magnet member 65*g* by magnetic fields formed by the first and second magnets 62 and 67, depending on the vibration of the diaphragm 65. In other words, in this embodiment, the non-magnet member 65*g* of the diaphragm 65, the first magnet 62, and the second magnet 67 play a role as a negative stiffness generating mechanism. Due to the negative stiffness generating mechanism, the acoustic stiffness of the empty room Wb6 is reduced.

As described above, in this embodiment, the electrostatic loudspeaker apparatus can exhibit an effect similar to that of the first embodiment. In addition, the electrostatic loudspeaker apparatus is widely used as a thin loudspeaker as in the sixth embodiment. Also, this embodiment can exhibit an effect similar to that of the sixth embodiment.

Although the loudspeaker apparatus has, for example, a circular outer shape in the above description, the present invention is not limited to this. For example, the outer shape may be an elliptical shape, a rectangular shape, a track shape, or the like. The rectangular shape may be a landscape shape (wider than it is tall). Although a closed-box type loudspeaker apparatus has been described as the loudspeaker apparatus of this embodiment in FIG. 9, the present invention is not limited to this. For example, the loudspeaker apparatus of this embodiment may be of other types, such as the bass-reflex type, the drone-cone type, and the like.

Figure 11:
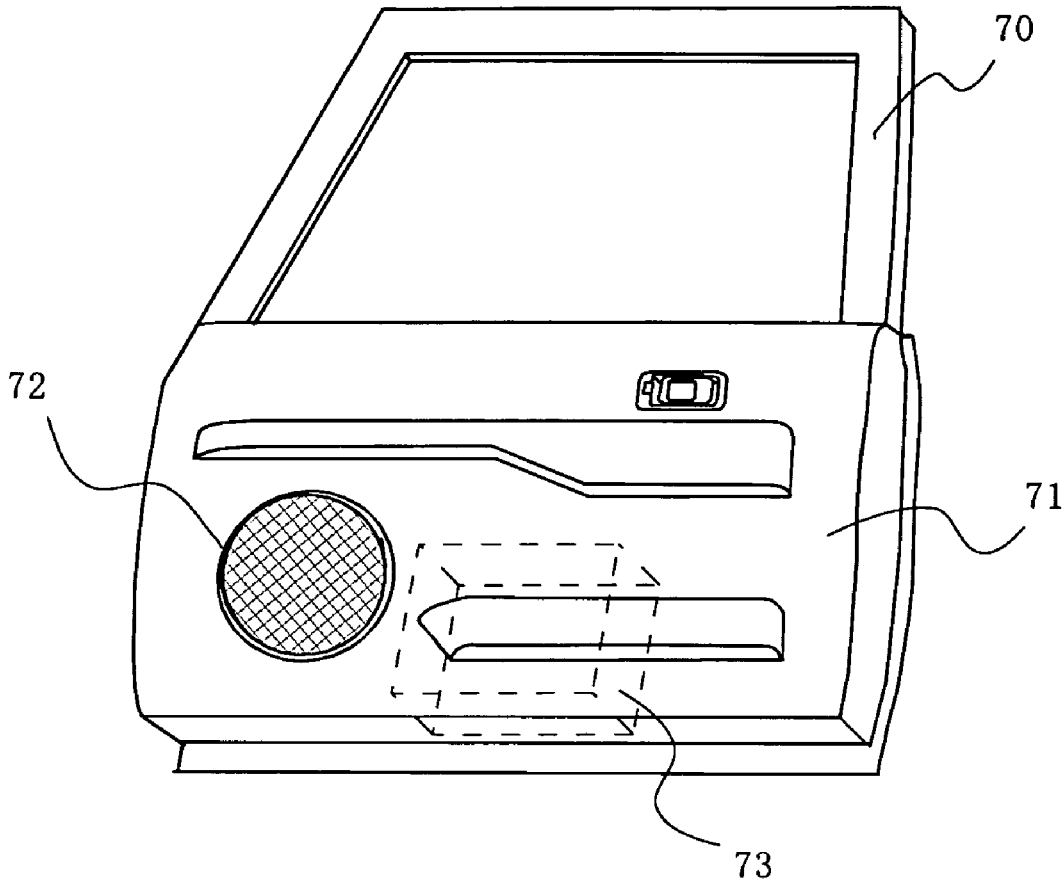
FIG. 11 is a diagram illustrating an example in which a loudspeaker unit is provided in a car door.

Note that the loudspeaker apparatuses of the first to seventh embodiments are provided inside the body of a car, as an example. For example, the loudspeaker apparatus is provided in a door of the car. FIG. 11 is a diagram illustrating an example in which a loudspeaker unit is provided in a car door. The car door is composed of a window portion 70, a door main body 71, a loudspeaker unit 72, and an adsorptive material 73.

In FIG. 11, the loudspeaker unit 72 is, for example, the loudspeaker unit 2*a* described above. The loudspeaker unit 72 is attached to the door main body 71. A space is formed inside the door main body 71. In other words, the door main body 71 is a housing which gives an acoustic stiffness to a diaphragm of the loudspeaker unit 72. The adsorptive material 73 is also provided inside the door main body 71. Thus, the door main body 71, the loudspeaker unit 72, and the adsorptive material 73 constitute a loudspeaker apparatus similar to that of the first embodiment. In addition to the above description, the loudspeaker apparatuses of the second to fifth embodiments may be applied to a car door. When the loudspeaker apparatuses of the first to seventh embodiments themselves are applied to a car door, only the loudspeaker apparatuses of the first to seventh embodiments may be attached instead of the loudspeaker unit 72.

Thus, by applying the loudspeaker apparatuses of the first to seventh embodiments to a car door, it is possible to provide an in-car listening environment in which a low-frequency sound reproduction band is expanded. A window glass storing section, an automatic window opening/closing mechanism, a door lock, wires, a control circuit, and the like are provided inside the door main body 71, the internal volume of the door main body 71 is limited. Therefore, in order to reproduce desired low-frequency sound, the acoustic stiffness of the door main body 71 needs to be significantly reduced. According to the first to seventh embodiments, the load to the negative stiffness generating mechanism is reduced, thereby making it possible to further expand a low-frequency reproduction band.

Figure 12:
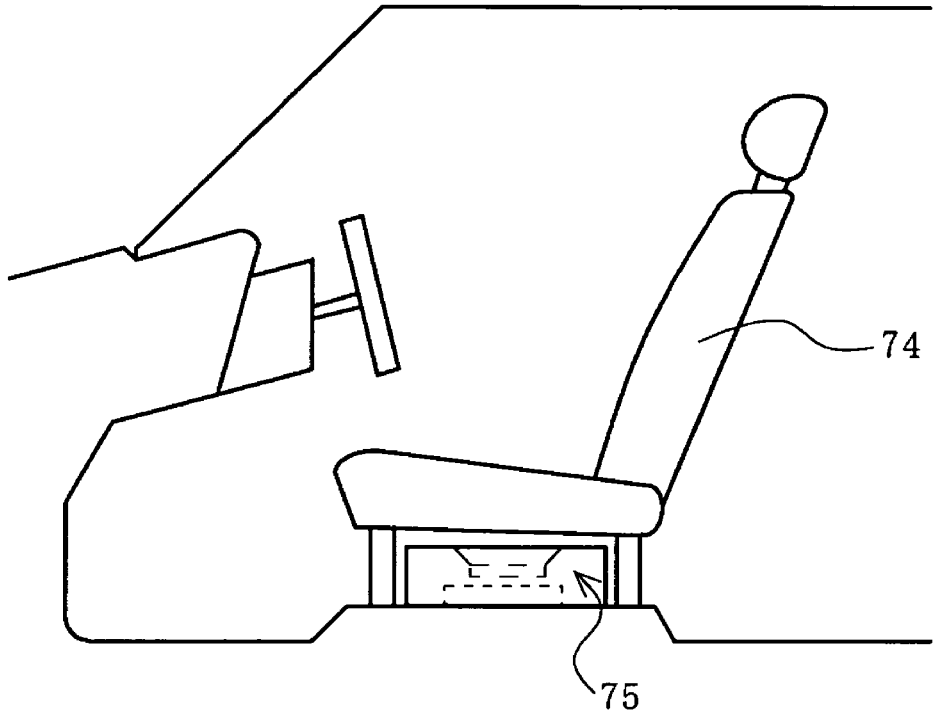
FIG. 12 is a diagram illustrating an exemplary loudspeaker apparatus which is provided inside a car body.

As another example, the loudspeaker apparatuses of the first of seventh embodiments may be provided inside the body of a car. FIG. 12 is a diagram illustrating an exemplary loudspeaker apparatus which is provided inside a car body. In FIG. 12, for example, the loudspeaker apparatus 75 is provided under a seat 74. Here, the loudspeaker apparatus 75 is any of the loudspeaker apparatuses of the first to fifth embodiments. Note that the loudspeaker apparatuses of the sixth and seventh embodiments may be provided using fixtures or the like.

Thus, by providing the loudspeaker apparatus 75 to a car, it is possible to provide an in-car listening environment in which a low-frequency sound reproduction band is expanded. Also, according to the first to seventh embodiments, it is possible to further expand a low-frequency reproduction band as compared to conventional loudspeaker apparatuses. Therefore, when it is aimed to achieve low-frequency sound reproduction to the same level as that of the conventional art, the cabinet of the loudspeaker apparatus 75 can be further reduced as compared to the conventional art. By providing the loudspeaker apparatus 75 in a car, a larger space can be secured in the car. The present invention is particularly effective for low-frequency sound loudspeaker apparatuses, such as a subwoofer and the like, which generally require a large volume cabinet.

Figure 13:
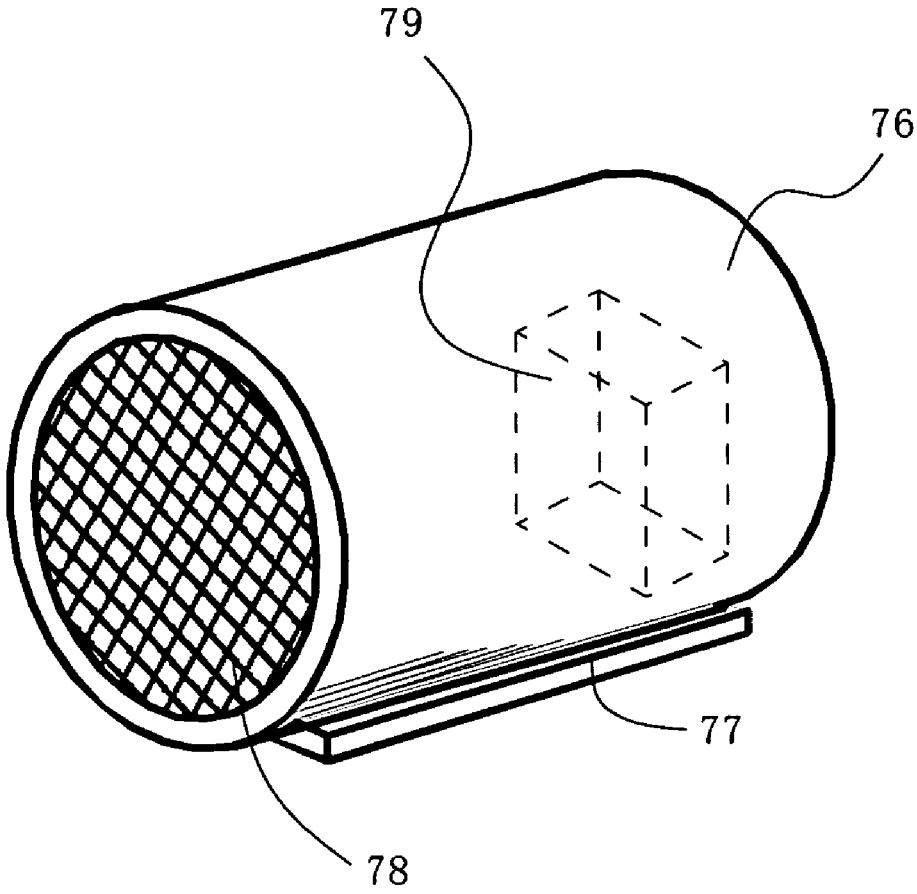
FIG. 13 is a diagram illustrating another exemplary loudspeaker apparatus which is provided inside a car body.

As another example, the loudspeaker apparatuses of the first of seventh embodiments may be an in-car loudspeaker apparatus illustrated in FIG. 13. FIG. 13 is a diagram illustrating another exemplary loudspeaker apparatus which is provided inside a car body. In FIG. 13, the loud speaker apparatus comprises a cabinet 76, a pedestal 77, a loudspeaker unit 78, and an adsorptive material 79.

In FIG. 13, the loudspeaker unit 78 is, for example, the loudspeaker unit 2*a* described above. The loudspeaker unit 78 is attached to the cabinet 76 which is in the shape of a cylinder. Note that the shape of the cabinet 76 is not limited to the cylindrical shape of FIG. 13, and may be a cuboidal shape or the like. The adsorptive material 79 is provided inside the cabinet 76. Thus, the cabinet 76, the loudspeaker unit 78, and the adsorptive material 79 constitute a loudspeaker apparatus similar to that of the first embodiment. Note that, in addition to the above description, the loudspeaker apparatuses of the second to fifth embodiments may be applied to the in-car loudspeaker apparatus of FIG. 13. When the first to seventh embodiments are applied to the in-car loudspeaker apparatus of FIG. 12, the loudspeaker apparatuses of the first to seventh embodiments themselves can be used.

Thus, by applying the loudspeaker apparatus of the first to seventh embodiments to an in-car loudspeaker apparatus, it is possible to provide an in-car listening environment in which a low-frequency sound reproduction band is expanded. According to the first to seventh embodiments, it is possible to further expand a low-frequency reproduction band as compared to conventional loudspeaker apparatuses. Therefore, when it is aimed to achieve low-frequency sound reproduction to the same level as that of the conventional art, the cabinet of the loudspeaker apparatus 76 can be further reduced as compared to the conventional art. By providing the loudspeaker apparatus 76 in a car, a larger space can be secured in the car. The present invention is particularly effective for low-frequency sound loudspeaker apparatuses, such as a subwoofer and the like, which generally require a large volume cabinet.

Also, the loudspeaker apparatuses of the first of seventh embodiments are provided in, for example, AV systems and the like. As an example, the loudspeaker apparatuses of the first of seventh embodiments are provided in video apparatuses (e.g., cathode-ray tube televisions, liquid crystal televisions, plasma televisions, etc.).

Figure 14:
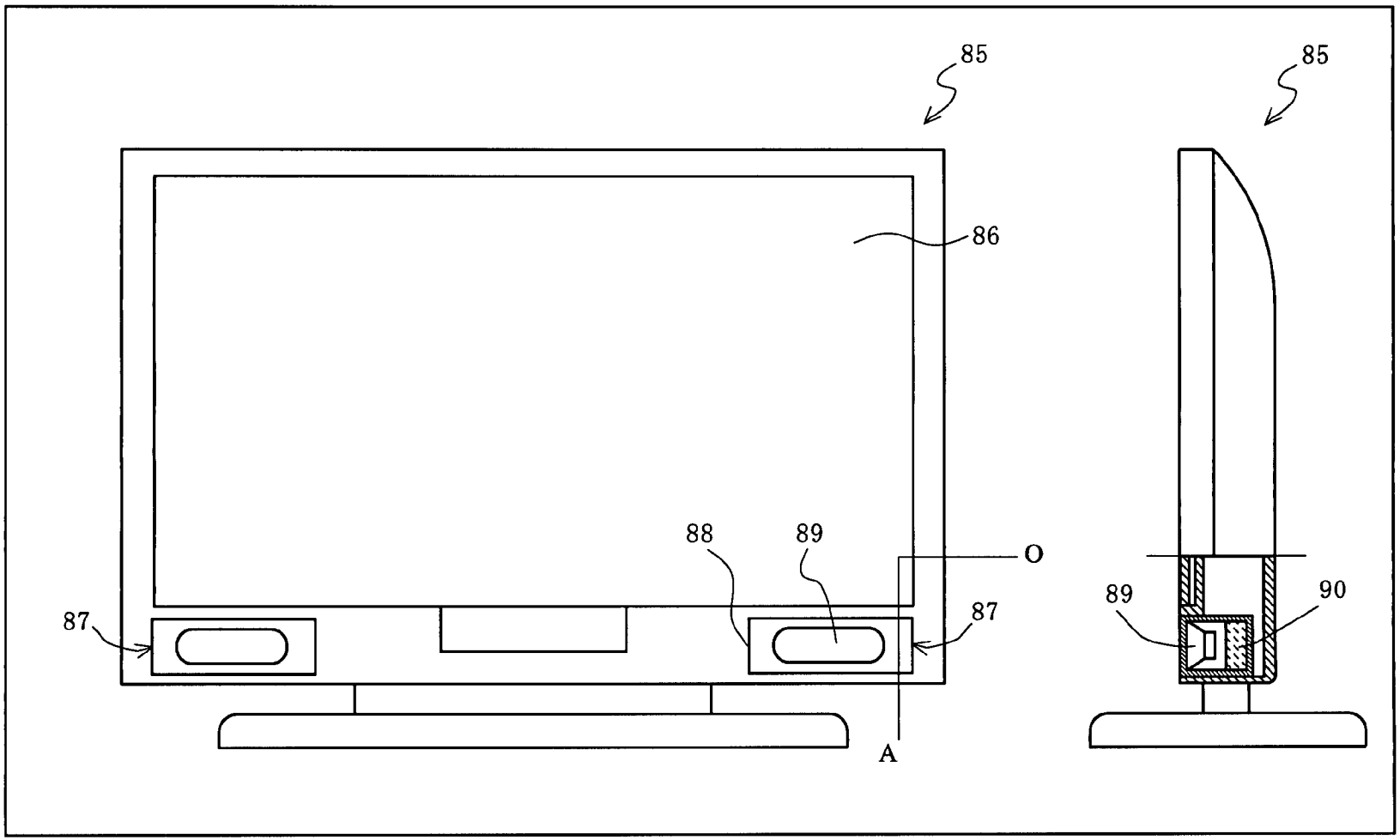
FIG. 14 is a diagram illustrating an exemplary configuration in which the loudspeaker apparatuses of the first to seventh embodiments are provided in a thin television.

FIG. 14 is a diagram illustrating an exemplary configuration in which the loudspeaker apparatus is provided in a thin television. FIG. 14 illustrates a front view of the thin television, and a cross-sectional, side view, partially taken along line O-A. In FIG. 14, the thin television roughly comprises a thin television main body 85, a display 86, and two loudspeaker apparatuses 87. The loudspeaker apparatus 87 comprises a cabinet 88, a loudspeaker unit 89, and an adsorptive material 90.

In FIG. 14, the cabinet 88 is provided in an internal space of an apparatus housing provided below the display 86. The loudspeaker unit 89 is, for example, an elliptical loudspeaker unit 2*a*. The loudspeaker unit 89 is attached to the cabinet 88. The adsorptive material 90 is provided inside the cabinet 88. Thus, the cabinet 76, the loudspeaker unit 78, and the adsorptive material 90 constitute a loudspeaker apparatus similar to that of the first embodiment. Note that, in addition to the above description, the loudspeaker apparatuses of the second to fifth embodiments may be provided in a thin television. When the loudspeaker apparatuses of the first to seventh embodiments are provided in a thin television, the loudspeaker apparatuses are attached directly to the internal space of the housing provided below the display 86.

Thus, by providing the loudspeaker apparatuses of the first to seventh embodiments to the thin television main body 85, it is possible to provide a listening environment in which a low-frequency sound reproduction band is expanded. Also, according to the first to seventh embodiments, when it is aimed to achieve low-frequency sound reproduction to the same level as that of the conventional art, the cabinet 88 of the loudspeaker apparatus can be further reduced as compared to the conventional art. In other words, by providing the loudspeaker apparatus 87, the thickness of a thin television can be further reduced.

Figure 15:
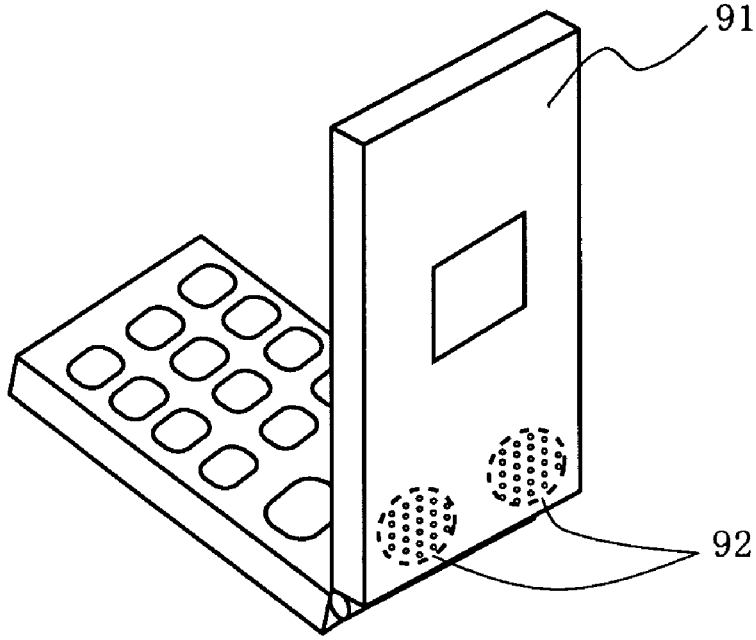
FIG. 15 is a diagram illustrating an exemplary configuration in which the loudspeaker apparatuses of the first to seventh embodiments are provided in a mobile telephone 91.

Also, the loudspeaker apparatuses of the first of seventh embodiments are used as a loudspeaker apparatus for a mobile information processing apparatus, such as a mobile telephone or the like. FIG. 15 is a diagram illustrating an exemplary configuration in which the loudspeaker apparatuses of the first to seventh embodiments are provided in a mobile telephone 91. Note that, in FIG. 15, a loudspeaker apparatus 92 is indicated with a dashed line. In FIG. 15, for example, any of the loudspeaker apparatuses of the first of seventh embodiments is provided as the loudspeaker apparatus 92 inside an apparatus housing provided in the mobile telephone 91. Note that, when the loudspeaker apparatuses of the first to fifth embodiments are used, a loudspeaker unit may be attached to an opening of a housing of the mobile telephone 91, and the adsorptive material 140 may be provided inside the housing.

Thus, by providing the loudspeaker apparatuses of the first to seventh embodiments in the mobile telephone 91, it is possible to provide a listening environment in which a low-frequency sound reproduction band is expanded. For example, mobile telephones (FIG. 15) are particularly becoming smaller and thinner. Accordingly, the space occupied by a loudspeaker apparatus is significantly limited. However, according to the loudspeaker apparatuses of the first to seventh embodiments, even when the same limited space as that of the conventional art is available, a low-frequency sound reproduction band can be expanded. Also, the loudspeaker apparatuses of the first to seventh embodiments can further expand a low-frequency sound reproduction band, and can also be applied to applications, such as small-size loudspeaker apparatuses, loudspeaker apparatuses for liquid crystal televisions or plasma displays, audio apparatuses, car audio apparatuses, in-car loudspeakers, and the like.

While the invention has been described in detail, the foregoing description is in all aspects illustrative and not restrictive. It is understood that numerous other modifications and variations can be devised without departing from the scope of the invention.

What is claimed is:

1. A loudspeaker apparatus comprising:

a housing having an opening formed therein;

an adsorptive material disposed inside the housing, and for physically adsorbing gas inside the housing;

a vibration section including a diaphragm and a diaphragm support member for supporting the diaphragm, the vibration section being disposed in the opening formed in the housing, the diaphragm support member having a stiffness;

a drive section for driving the diaphragm to generate sound from the diaphragm; and a negative stiffness generating mechanism disposed inside the housing, the negative stiffness mechanism for generating a negative stiffness and for reducing an acoustic stiffness inside the housing, the acoustic stiffness acting on the diaphragm, wherein a stiffness acting on the diaphragm is determined based on the acoustic stiffness, the stiffness of the diaphragm support member, an amount by which the acoustic stiffness is reduced due to the adsorptive material, and the negative stiffness generated by the negative stiffness generating mechanism, and wherein the negative stiffness generated by the negative stiffness generating mechanism is less than a value resulting from subtracting, from the sum of the acoustic stiffness and the stiffness of the diaphragm support member, the amount by which the acoustic stiffness is reduced due to the adsorptive material, wherein the drive section includes:

a first magnetic circuit disposed inside the housing and having a first magnet closer to the diaphragm; and a second magnetic circuit having a second magnet disposed facing the first magnet via the diaphragm and a gap formed in a vibration direction of the diaphragm, wherein a predetermined magnetic gap being formed in at least one of the first and second magnetic circuits, the vibration section further includes:

a voice coil disposed in the magnetic gap;

a voice coil bobbin fixedly disposed on the diaphragm, and for disposing the voice coil in the magnetic gap and supporting the voice coil; and a non-magnet member, which is a magnetic material, and which does not include a magnet, and is disposed in at least a portion of the diaphragm provided in the gap, the negative stiffness generating mechanism includes:

the non-magnet member;

the first magnetic circuit; and the second magnetic circuit, a balanced position in the gap of the non-magnet member being a reference with respect to a vibration direction of the diaphragm, and the negative stiffness generating mechanism applies repelling force in the vibration direction to the non-magnet member in a direction which allows the non-magnet member to move away from the balanced position, thereby reducing the acoustic stiffness inside the housing.

2. The loudspeaker apparatus according to claim 1, wherein the adsorptive material is composed of at least one of activated charcoal, zeolite, carbon nanotube, fullerene, silica gel, and porous silica.

3. The loudspeaker apparatus according to claim 1, further comprising:

a position detecting section for detecting a position in the vibration direction of any of the members of the vibration section vibrating in the vibration direction; and a control section for applying, to the voice coil, a signal obtained by adding a direct-current component based on the position of the vibration section detected by the position detecting section to a predetermined acoustic signal, to control vibration of the diaphragm so that a center of an amplitude in the vibration direction of the non-magnet member is provided at the balanced position.

4. The loudspeaker apparatus according to claim 1, wherein the negative stiffness generating mechanism includes:

a partition for dividing an internal space of the housing into a first empty room and a second empty room;

a drone cone disposed in an opening formed in the partition;

a suspension having an outer circumference fixed to the partition, for supporting the drone cone in a manner which allows the drone cone to vibrate with respect to the partition; and a repelling force generating section for, a balanced position in a vibration direction of the drone cone being a reference, generating repelling force in the vibration direction with respect to the drone cone in a direction which allows the drone cone to move away from the balanced position.

5. The loudspeaker apparatus according to claim 4, wherein the repelling force generating section includes:

a non-magnet member which is a magnetic material which does not include a magnet, and is disposed in at least a portion of the drone cone; and a plurality of magnets forming a predetermined gap on each of a front side and a rear side in the vibration direction of the drone cone with respect to the non-magnet member disposed in at least a portion of the drone cone, and fixedly positioned, facing the non-magnet member disposed in at least a portion of the drone cone.

6. The loudspeaker apparatus according to claim 4, wherein the repelling force generating section comprises:

a magnet disposed in at least a portion of the drone cone; and a plurality of non-magnet members which are a magnetic material which does not include a magnet, wherein the plurality of non-magnet members form a predetermined gap on each of a front side and a rear side in the vibration direction of the drone cone with respect to the magnet, and are each fixedly provided, facing the magnet.

7. The loudspeaker apparatus according to claim 1, further comprising a fixed magnet fixedly disposed to the housing at a position closer to the outside of the housing than the vibration section, and having at least a partial shape of a ring, wherein the vibration section further includes:

a movable magnet having at least a partial shape of a ring having an outer circumference smaller than an inner circumference of the fixed magnet; and a support member for providing the movable magnet at a position which allows an outer circumferential surface of the movable magnet to face an inner circumferential surface of the fixed magnet via a predetermined gap, and supporting the movable magnet in a manner which allows the movable magnet to be fixedly disposed to the diaphragm and vibrate together with the diaphragm, wherein the negative stiffness generating mechanism is composed of the fixed magnet and the movable magnet, a balanced position in the gap of the movable magnet is a reference with respect to a vibration direction of the diaphragm, and the negative stiffness generating mechanism applies repelling force in the vibration direction to the movable magnet in a direction which allows the movable magnet to move away from the balanced position, thereby reducing the acoustic stiffness inside the housing.

8. The loudspeaker apparatus according to claim 7, wherein a magnetic gap is formed in the drive section, the vibration section further includes a voice coil which is disposed in the magnetic gap formed in the drive section and vibrates together with the diaphragm, and the loudspeaker apparatus further comprises:

a position detecting section for detecting a position in the vibration direction of any of the members of the vibration section vibrating in the vibration direction; and a control section for applying, to the voice coil, a signal obtained by adding a direct-current component based on the position of the vibration section detected by the position detecting section to a predetermined acoustic signal, to control vibration of the diaphragm so that a center of an amplitude in the vibration direction of the movable magnet is disposed at the balanced position.

9. The loudspeaker apparatus according to claim 1, wherein the drive section is a piezoelectric converter.

10. The loudspeaker apparatus according to claim 9, wherein the diaphragm is composed of one of a non-magnet member which is a magnetic material which does not include a magnet, and a member provided with the non-magnet member thereoutside, the drive section is a piezoelectric element disposed in the diaphragm, and the loudspeaker apparatus further comprises:

a position detecting section for detecting a position in the vibration direction of any of the members of the vibration section vibrating in the vibration direction; and a control section for applying, to the piezoelectric element, a signal obtained by adding a direct-current component based on the position of the vibration section detected by the position detecting section to a predetermined acoustic signal, to control vibration of the diaphragm so that a center of an amplitude in the vibration direction of the non-magnet member in the diaphragm is disposed at the balanced position of the non-magnet member in the diaphragm.

11. The loudspeaker apparatus according to claim 1, wherein the drive section is an electrostatic converter.

12. The loudspeaker apparatus according to claim 11, wherein the diaphragm is composed of one of a non-magnet member which is a magnetic material which does not include a magnet, and a member provided with the non-magnet member thereoutside, the drive section includes an electrode disposed via a gap with respect to each of both surfaces of the diaphragm, and the loudspeaker apparatus further comprises:

a position detecting section for detecting a position in the vibration direction of one of the members of the vibration section vibrating in the vibration direction; and a control section for applying, to the electrode, a signal obtained by adding a direct-current component based on the position of the vibration section detected by the position detecting section to a predetermined acoustic signal, to control vibration of the diaphragm so that a center of an amplitude in the vibration direction of the non-magnet member in the diaphragm is disposed at the balanced position of the non-magnet member in the diaphragm.

13. The loudspeaker apparatus according to claim 1, further comprising:

a support member provided to partition between the adsorptive material, and the vibration section, the drive section and the negative stiffness generating mechanism, for supporting the adsorptive material.

14. A car comprising:

the loudspeaker apparatus according to claim 1; and a car body inside which the loudspeaker apparatus is disposed.

15. A video apparatus comprising:

the loudspeaker apparatus according to claim 1; and an apparatus housing inside which the loudspeaker apparatus is disposed.

16. A mobile information processing apparatus comprising:

the loudspeaker apparatus according to claim 1; and an apparatus housing inside which the loudspeaker apparatus is disposed.

* * * * *